US006815138B2

(12) United States Patent
Aono

(10) Patent No.: US 6,815,138 B2
(45) Date of Patent: Nov. 9, 2004

(54) HEAT-SENSITIVE RECORDING MATERIAL

(75) Inventor: Toshiaki Aono, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 194 days.

(21) Appl. No.: 10/244,155

(22) Filed: Sep. 16, 2002

(65) Prior Publication Data

US 2003/0114306 A1 Jun. 19, 2003

(30) Foreign Application Priority Data

Sep. 21, 2001 (JP) ..... 2001-288930

(51) Int. Cl.[7] ..... G03C 1/60; G03C 1/61; G03C 1/73; B41M 5/20; B41M 5/24

(52) U.S. Cl. ..... 430/138; 430/162; 430/169; 430/338; 430/637; 430/964; 503/204; 503/209; 503/213

(58) Field of Search ..... 430/138, 162, 430/169, 338, 637, 964; 503/209, 213, 204

(56) References Cited

U.S. PATENT DOCUMENTS 5,053,267 A 10/1991 Ide et al.
5,096,781 A * 3/1992 Vieira et al.
5,248,555 A * 9/1993 Matsushita et al.
6,197,724 B1 3/2001 Aono
6,278,008 B1 * 8/2001 Endo et al.
6,339,041 B1 1/2002 Aono

OTHER PUBLICATIONS

Japanese Abstract No. 2000 118138, dated Apr. 25, 2000.

* cited by examiner

*Primary Examiner*—Richard L. Schilling
(74) *Attorney, Agent, or Firm*—Sughrue Mion, PLLC

(57) ABSTRACT

A heat-sensitive recording material includes a support having disposed thereon a heat-sensitive recording layer and a protective layer. The heat-sensitive recording layer contains at least two components that react to develop color by imagewise heating. At least one layer contains a compound represented by the following general formula (I). In the general formula (I), R represents a hydrophobic group or a hydrophobic polymer, and n represents an integer.

General formula (I)

19 Claims, No Drawings

HEAT-SENSITIVE RECORDING MATERIAL

BACKGROUND OF THE INVENTION

1. Field of the Invention

The present invention relates to a heat-sensitive recording material. More specifically, the present invention concerns a heat-sensitive recording material having a layer structure formed on a support, which includes a heat-sensitive recording layer containing at least two kinds of components that can develop colors by imagewise heating, a protective layer and the like. The recording material has good film quality, and is superior in transparency, gloss-applying property and light resistance, and has a high color-developing sensitivity, and can be written on using a thermal head or an infrared laser.

2. Description of the Related Art

In recent years, heat-sensitive recording techniques have developed greatly since recording devices therefor are simple, have high reliability and require no maintenance. As heat-sensitive recording materials, a variety of materials such as those materials which utilize a reaction between an electron-donating colorless dye and an electron-accepting compound and those materials which utilize a reaction between a diazonium salt compound and a coupler have been widely known.

Recently, studies have been vigorously carried out with respect to the heat-sensitive recording materials so as to improve characteristics thereof such as (i) coloring density and coloring sensitivity and (ii) fastness of coloring materials. However, the heat-sensitive recording materials have problems that when the materials having images are exposed to sunlight for a long time or when the materials are posted on a bulletin board for a long time in an office or the like, the background portions are colored by light, and image portions are discolored or faded. In order to improve coloring on the background portions, and discoloration and fading in image portions, various methods have been proposed. However, a method, which satisfies the above demands, overcome the problems and provide sufficient effect, has not obtained yet.

Need with respect to heat-sensitive recording systems in the various fields such as facsimiles, printers, labels and the like is increasing. Accompanying this is a large demand for a high writing sensitivity and a high image quality of obtained images in a heat-sensitive recording paper that is imagewise recordable by a heat-sensitive recording head or an infrared laser. Conventionally, in order for light resistance and high film quality of heat-sensitive recording material to be compatible with the high sensitivity of the same, one of two coloring components that react with each other by heating and form a color is enclosed in microcapsules. The microcapsules prevent the coloring components from reacting with each other and develop colors during storage of the heat-sensitive recording material. However, the microcapsules tend to aggregate with each other during a solution preparation process and while the prepared solution is preserved for an application process. Therefore, it has been difficult to provide uniform dispersion and to have uniform, high quality images. Moreover, in the case when the other coloring components for the coloring reaction are blended as an emulsion or when a latex dispersing solution is added to improve the film quality and the like, occurrence of the aggregation of microcapsules tends to be accelerated.

Further, hydrophobic compounds have been used by being dissolved in oil and the like then adding the oil to an application solution as an emulsion. However, in such a case, deposition of the hydrophobic compounds, combination of particles of the emulsion and the like tend to occur while the dissolution is preserved or while the dissolution is preserved in cold storage, and resulting in degradation in the image quality.

In order to improve durability, a layer containing capsules including a precursor of an ultraviolet-ray absorbing agent may be disposed at an outermost layer of a heat-sensitive recording material as a light-transmittance adjusting layer. However, in this case, these capsules tend to cause aggregation and the aggregation tends to cause failure in manufacturing processes. In this way, there is a demand for a heat-sensitive recording material which can provide superior image quality with uniform hues by preventing aggregations of microcapsules and latex, which are contained in layers of the heat-sensitive recording material, and achieving an uniformly dispersion thereof. However, in particular, there is a major problem, which is caused without regard to the layer structure of the protective layer, the heat-sensitive recording layer and the like. Namely, when a solid matter such as a latex or an emulsified dispersing substance coexists with microcapsules in a microcapsule dispersing solution, the possibility of aggregation occurring becomes extremely high.

SUMMARY OF THE INVENTION

An object of the present invention is to provide a heat-sensitive recording material which can improve the dispersing stability of coloring components and film-quality improving components contained in the heat-sensitive recording material, provide uniform image quality in obtained images, and form images having superior transparency and glossiness with high sensitivity, which images are formed by imagewise heating using a thermal head or an infrared laser. Another object of the invention is to provide a heat-sensitive recording material which can form images with uniform image quality and high sensitivity that are superior in transparency and glossiness, by preventing the aggregation of capsules enclosing coloring components, an emulsion substance and a latex comprised in a latex dispersing solution that is added so as to improve film quality (for example, improvement of a blister white-fogging defect that is generated by moisture or nitrogen gas that has been generated by photo decomposition of a diazo compound and expanded by heating at the time of printing).

In order to achieve the above-mentioned object, the inventors of the invention studied earnestly, and found that a polymer which has been known as an additive of photographic elements is very useful as a dispersant of microcapsules, an emulsion substance and a latex, thereby completing the present invention.

The first aspect of the invention provides a heat-sensitive recording material comprising a support having disposed thereon plural layers including at least one heat-sensitive recording layer and a protective layer, the heat-sensitive recording layer containing at least two components that react with each other to form color by imagewise heating, wherein at least one of the plural layers contains a compound represented by the following general formula (I):

General formula (I)

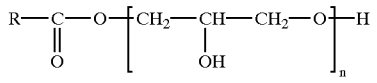

wherein R represents one of a hydrophobic group and a hydrophobic polymer, and n represents an integer.

Examples of a layer which may be comprised in the plural layers include all layers which may be provided to and/or used for the heat sensitive recording material. For examples, back layer and the like are also included.

The second aspect of the invention provides a method of manufacturing a heat-sensitive recording material, which includes a support and plural layers including a protective layer and at least one heat-sensitive recording layer containing at least two components that react with each other to form color by imagewise heating, the method comprising the steps of:

preparing a coating solution containing the at least two components that react to form a color by imagewise heating and a compound represented by the following general formula (I);

General formula (I)

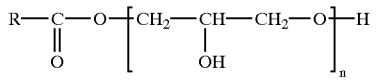

applying the solution onto a support and drying the solution to form the heat sensitive recording layer; and forming the protective layer, wherein, in the general formula (I), R represents one of a hydrophobic group and a hydrophobic polymer, and n represents an integer.

DETAILED DESCRIPTION OF THE INVENTION

Preferred embodiments of a heat-sensitive recording material of the present invention will be described below.

The heat-sensitive recording material of the invention has a layer structure including at least, at least one of heat-sensitive recording layer containing at least two kinds of components that can form a color by heating, (imagewise heating when image formation is carried out), and at least one of a protective layer, which layers are formed on a support. The heat-sensitive recording material is characterized in that at least one layer of the above-mentioned layer structure contains a compound represented by the following general formula (I). As one embodiment of the invention, a heat-sensitive recording material, which is made by successively forming a heat-sensitive recording layer containing at least two kinds of components that can form color by imagewise heating and a protective layer on a support, may be characterized in that one of the two kinds of components that react with each other by heating to form color is enclosed in microcapsules, and a compound represented by the following general formula (I) is contained in at least the heat-sensitive recording layer. Moreover, as another embodiment of the invention, at least one of layers of a heat-sensitive recording layer and its adjacent layer(s) may contain a latex that is dispersion-stabilized by the compound represented by the following general formula (I).

General formula (I)

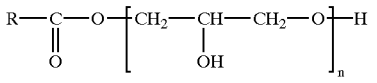

In the general formula (I), R represents a hydrophobic group or a hydrophobic polymer, and n represents an integer. The above-mentioned n preferably represents a number in the range of from 2 to 30, more preferably 3 to 25, and most preferably 4 to 20. Here, by setting n to be in the range of from 2 to 30, it is possible to provide a water-soluble material that satisfies the effects of the invention.

Examples of the hydrophilic group represented by R of general formula (I) include aliphatic groups such as alkyl groups, alkenyl groups and alkynyl groups, aromatic groups such as phenyl groups and naphthyl groups and alicyclic groups, and these groups may have substituents. Examples of the substituent include an aliphatic group, an aromatic group, an alicyclic group, a heterocyclic group, a halogen atom, a hydroxyl group, a cyano group, a nitro group, an N-substituted sulfamoyl group, a carbamoyl group, acylamino group, an alkylsulfonylamino group, an arylsulfonylamino group, an alkoxy group, an aryloxy group, an aralkyl group and an acyl group.

When the hydrophobic group represented by R in the general formula (I) is an alkyl group, the number of carbon atoms is preferably from 3 to 70, more preferably 4 to 50 and most preferably 8 to 24. Among these, the most preferably number of carbon atoms is 12.

In the case when R of the general formula (I) is a hydrophobic polymer, examples of the hydrophobic polymer include polystyrenes and derivatives thereof, polymethacrylates (e.g., polymethylmethacrylate) and derivatives thereof, polyacrylates and derivatives thereof, water-insoluble vinyl polymers and vinyl copolymers such as a polybutene, a polyvinyl acetate and a poly vinyl versatic acid, water-insoluble polyoxyalkylenes such as a polyoxypropylene and a polyoxytetramethylene, and water-insoluble polymers such as a polyamide and a polyester. In particular, the polystyrene and derivatives thereof, the polymethacrylate and derivatives thereof, the polyacrylate and derivatives thereof and polyvinylchloride are preferably used. Moreover, the degree of polymerization of the hydrophilic polymer is preferably 2 or more and 500 or less, more preferably 2 or more and 200 or less, and most preferably 2 or more and 100 or less.

Specific examples in which R of the general formula (I) is a hydrophilic group is shown below. However, the invention is not intended to be limited thereto.

$n\text{-}C_{12}H_{25}$— (S-1)

$C_{16}H_{33}$— (S-2)

$C_{12}H_{25}NHCOCH_2$— (S-3)

$C_{12}H_{25}OCH_2CH_2$— (S-4)

$(C_{18}H_{37})_2NCH_2CH_2CH_2$— (S-5)

$C_2H_5SO_2CH_2CH_2$— (S-6)

-continued
(S-7)
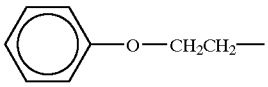
(S-8)
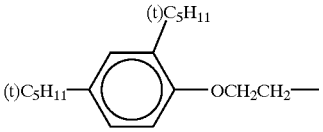
(S-9)
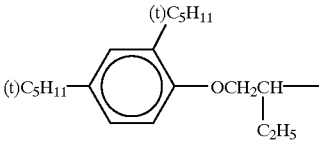
(S-10)
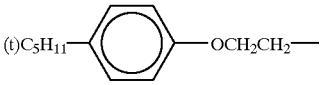
(S-11)
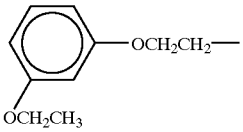
(S-12)
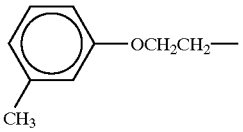
(S-13)
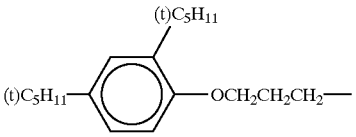
(S-14)
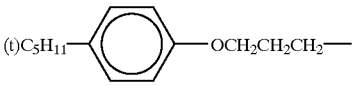
(S-15)
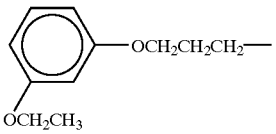
(S-16)
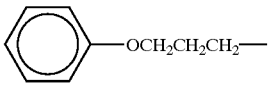
(S-17)
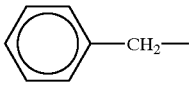
(S-18)
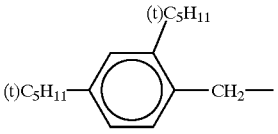
-continued
(S-19)
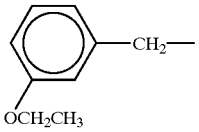
(S-20)
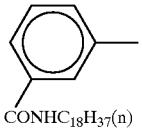
(S-21)
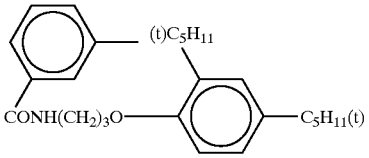
(S-22)
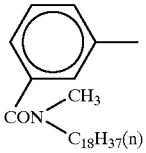
(S-23)
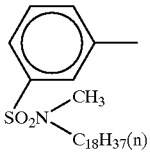
(S-27)
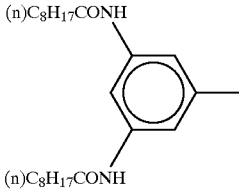
(S-28)
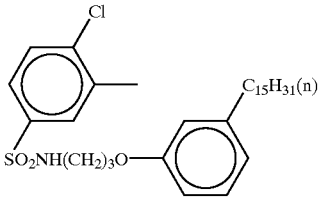
(S-29)
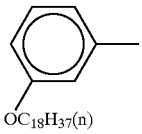
(S-30)
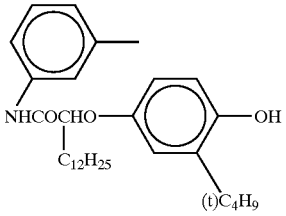

-continued
(S-31)
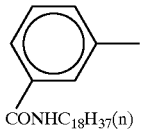
(S-32)
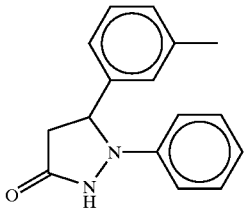
(S-33)
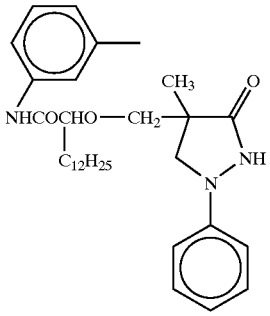
(S-34)
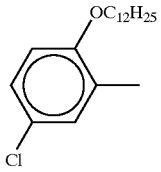
(S-35)
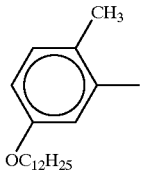
(S-36)
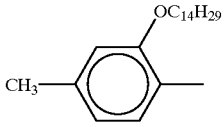
(S-37)
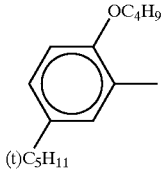
(S-38)
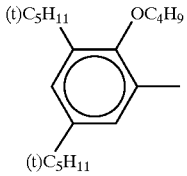
-continued
(S-39)
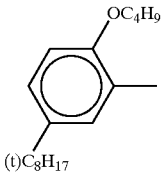
(S-40)
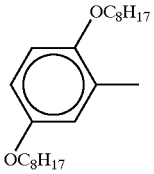
(S-41)
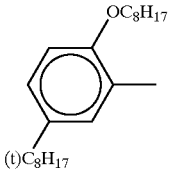
(S-42)
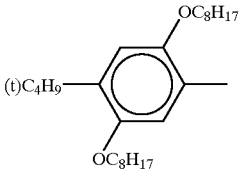
(S-43)
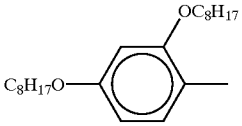
(S-44)
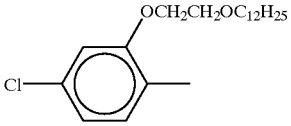
(S-45)
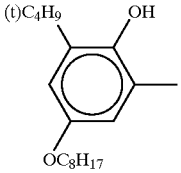
(S-46)
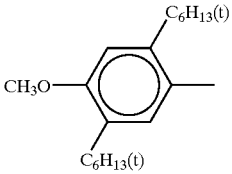
(S-47)
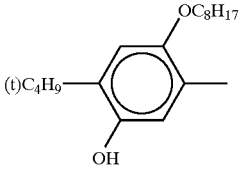

-continued (S-48)

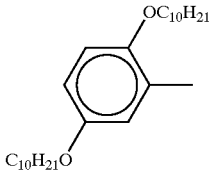

(S-49)

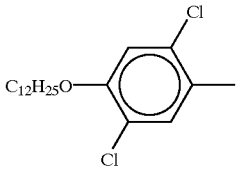

(S-50)

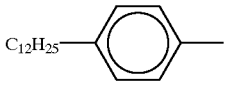

(S-51)

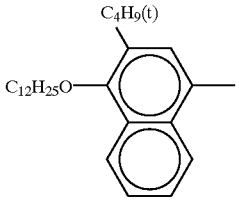

Examples of the compound represented by general formula (I) of the invention include a wide range of compounds from those having a water-soluble property to those having a water dispersing property.

Gelatin is generally used for the material of the heat-sensitive material, because of its proper manufacturing appropriateness, physical properties and the like. The compound represented by general formula (I) of the invention can be compatible with gelatin without causing a phase separation; therefore, gelatin is preferably used.

The compound represented by general formula (I) may be synthesized by a method described in, for example, Japanese Patent Application Laid-Open (JP-A) No. 09-157384 and the like.

The function of this compound for preventing aggregation of microcapsules and latex is not clearly known. However, it is believed to be as follows. The compound represented by general formula (I) has a hydrophobic group and also has a polymer unit (water-soluble portion) within the molecules thereof. Therefore, due to affinity between the hydrophobic group of the compound and the shell of microcapsules and/or the surface of dispersed latex fine particles, this compound can be adsorbed on the surface of the fine particles and/or the shell. On the other hand, the polymer unit of the compound exists on the side of a dispersion medium, thereby increasing the dispersion stability of the fine particles and the microcapsules.

The heat-sensitive recording layer of the present invention may be a full-color heat-sensitive recording layer or a mono-color heat-sensitive recording layer as long as it has a function wherein only coloring components in the heated region react with each other to form color(s) by imagewise heating. Namely, the heat-sensitive recording layer of the present invention may be a single layer or multiple layers.

In the case that the heat-sensitive recording layer of the invention is a mono-color recording layer, a coloring component A, which is a substantially colorless material, and a coloring component B, which is also a substantially colorless material and forms a color when reacted with the coloring component A, are contained in the layer. The coloring component A and the coloring component B to be used in the invention are components that can cause a color forming reaction with each other by heating. Examples of the combinations of the coloring component A and the coloring component B include the following combinations (a) to (m) listed below.

(a) A combination of a photo decomposable diazo compound and a coupler.

(b) A combination of an electron-donating dye precursor and an electron-accepting compound.

(c) A combination of an organic metal salt such as silver behenate and silver stearate, and a reducing agent such as protocatechuic acid, spiroindane and hydroquinone.

(d) A combination of a long chain aliphatic acid salt such as ferric stearate or ferric myristate and phenols such as tannic acid, gallic acid or ammonium salicylate.

(e) A combination of an organic acid heavy metal salt such as a nickel, cobalt, lead, copper, iron, mercury or silver salt of acetic acid, stearic acid or palmitic acid and an alkali earth metal sulfide such as calcium sulfide, strontium sulfide or potassium sulfide, or combinations between the above-mentioned organic acid heavy metal salt and an organic chelating agent such as s-diphenylcarbazide or diphenylcarbazone.

(f) A combination of a heavy metal sulfate such as a sulfate of silver, lead, mercury or sodium and a sulfur compound such as Na-tetrathionate, thiosulfate soda or thiourea.

(g) A combination of a ferric salt of fatty acid such as ferric stearate and an aromatic polyhydroxy compound such as 3,4-hydroxytetraphenylmethane.

(h) A combination of an organic metal salt such as oxalate or mercury oxalate and an organic polyhydroxy compound such as polyhydroxy alcohol, glycerin or glycol.

(i) A combination of a ferric salt of a fatty acid such as ferric pelargonate or ferric laurate and thiosecylcarbamide or isothiosecylcarbamide derivative.

(j) A combination of a lead salt of an organic acid such as lead capronate, lead pelargonate or lead behenate and a thiourea derivative such as ethylenethiourea or N-dodecylthiourea.

(k) A combination of a heavy metal salt of a higher fatty acid such as ferric stearate or copper stearate and zinc dialkyldithiocarbamate.

(l) A combination which forms an oxazin dye such as a combination of resorcin and nitroso compound.

(m) A combination of a formazane compound and a reducing agent and/or a metal salt.

Among these combinations, (a) the combination of a photodecomposable diazo compound and a coupler, (b) the combination of an electron-donating dye precursor and an electron-accepting compound and (c) the combination of an organic metal salt and a reducing agent are preferably used in the invention, and combinations of (a) and (b) are more preferable, and the combination (a) is most preferable.

In particular, in the case that the heat-sensitive recording material of the present invention is a full-color type, those materials of the combinations of (a) and (b), namely those materials utilizing a reaction between a diazonium salt compound and a coupler or those materials utilizing a reaction between an electron-donating colorless dye and an electron-accepting compound are preferably used. For example, with respect to the above-mentioned heat-sensitive recording layer, the heat-sensitive recording material is preferably provided with at least one heat-sensitive recording layer containing an electron-donating dye precursor and an electron-accepting compound and a heat-sensitive recording layer containing a diazonium salt compound and a coupler that reacts with the diazonium salt compound to form colors.

In the invention, the application modes and using method of the above-mentioned diazonium salt compound, the coupler that reacts with the diazonium salt compound to develop colors by heating, the basic material, the electron-donating colorless dye, the electron-accepting compound and the sensitizing agent are not particularly limited. In other words, these materials can be utilized by any method such as (i) a method in which the material(s) is dispersed in a solid-state and used, (ii) a method in which the material(s) is dispersed in an emulsion and used, (iii) a method in which the material(s) is dispersed in a polymer and used, (iv) a method in which the material(s) is dispersed in a latex and used, and (v) a method in which the material(s) is formed into microcapsules and used. Among these methods, from the viewpoint of preservability, the method in which the material is formed into microcapsules and used is preferable. In particular, when a color-developing system utilizing the reaction between a diazonium salt compound and a coupler is utilized, the diazonium compound is preferably encapsulated, and when a color-developing system utilizing the reaction between an electron-donating colorless dye and an electron-accepting compound is utilized, the electron-donating colorless dye is preferably encapsulated. In other words, with respect to the heat-sensitive layer, the heat-sensitive recording material preferably comprises at least one heat-sensitive coloring layer containing a diazo compound enclosed into microcapsules, a coupler that reacts with the diazo compound to develop colors and a binder as main components. Alternatively, the heat-sensitive recording material preferably comprises at least one heat-sensitive coloring layer containing an electron-donating dye precursor and an electron-accepting compound as main components wherein at least one of the electron-donating dye precursor and the electron-accepting compound is enclosed into microcapsules.

The compound of the present invention has a function for preventing aggregation and composite of microcapsules, emulsion and latex, and can improve dispersion stability of the solid-state dispersing materials. Therefore, the compound of the present invention make it possible to provide good image quality with superior gloss and uniform graininess. Here, the particle size of microcapsules is from 0.1 $\mu$m to 1.0 $\mu$m, and the size of microcapsules is not negligible when it is compared with size of the latex fine particles since most of the latex fine particles are not more than 0.2 $\mu$m. However, even in the case that the microcapsules are comprised in the recording layer, high gloss and superior image quality can be achieved since superior dispersibility and uniform graininess are achieved by the usage of the compound of the present invention. Therefore, the effects of the invention are large when the microcapsules are used.

The effects of the invention are preferably obtained when the compound represented by general formula (I) is added during the emulsifying process or during the process of preparing a coating solution for the layer containing the above-mentioned microcapsules or latex dispersion. Here, one of the two components for forming color is preferably comprised in microcapsules contained the solution. The other component for forming color may comprised in the emulsion, outside the microcapsules or the latex dispersion. The emulsion, solution containing microcapsules and latex dispersion may be mixed to form a coating solution for forming a heat sensitive recording layer. For example, a dispersion containing microcapsules comprising one of the two components, an emulsion comprising the other component of the two components and a latex dispersion comprising the compound represented by the general formula (I) may be prepared, and mixed to form a coating solution for a heat sensitive recording layer.

When the compound represented by general formula (I) is added to the microcapsule dispersing solution or emulsion, the amount of the compound is preferably 0.5 to 15% by weight with respect to the solid component of the capsules or oil droplets. When the compound is added to the latex dispersing solution, the amount of the compound is preferably 1 to 20% by weight based on the latex.

Next, respective coloring components will be described below.

Examples of compounds used for the heat-sensitive recording layer, which contains a diazonium salt compound and a coupler that reacts with the diazonium salt compound to form a color by heating, include diazonium salt compounds, couplers that react with the diazonium salt compound to form a color and basic substances for accelerating the reaction between the diazonium salt compound and the coupler. The diazonium salt compounds is represented by the following general formula, and the maximum absorbing wavelength thereof can be controlled by the position and the kind of the substituent(s) which can be provided to the Ar portion.

$$Ar—N_z^+X^-$$

Ar represents an aryl group, and $X^-$ represents an acid anion.

Specific examples of the diazonium salt compound of the invention include acid anion salts such as a 4-(N-(2-(2,4-di-tert-amylphenoxy)butyryl)piperazino) benzenediazonium, a 4-dioctylaminobenzenediazonium, a 4-(N-(2-ethylhexanoyl)piperazino)benzenediazonium, a 4-dihexylamino-2-hexyloxybenzenediazonium, a 4-N-ethyl-N-hexadecylamino-2-ethoxybenzodiazonium, a 3-chloro-4-dioctylamino-2-octyloxybenzenediazonium, a 2,5-dibutoxy-4-morpholinobenzenediazonium, a 2,5-octoxy-4-morpholino benzenediazonium, a 2,5-dibutoxy-4-(N-(2-ethylhexanoyl)piperazino)benzenediazonium, a 2,5-diethoxy-4-(N-(2-(2,4-di-tert-amylphenoxy)butyryl) piperazino)benzenediazonium, a 2,5-dibutoxy-4-tolylthiobenzenediazonium, and a 3-(2-octyloxyethoxy)-4-morpholinobenzenediazonium, and following diazonium salt compounds D-1 to 5. In particular, a hexafluorophosphate salt, a tetrafluoroborate salt and a 1,5-naphthalenesulfonate salt are preferably used.

D-1

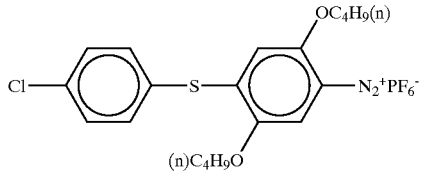

-continued

D-2

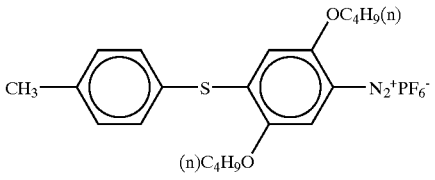

D-3

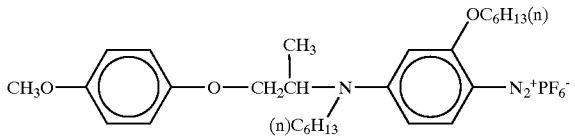

D-4

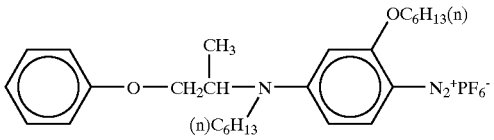

D-5

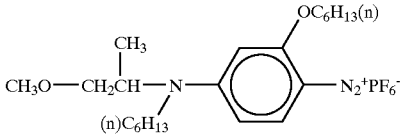

Among these diazonium salt compounds, particularly preferable compounds are the following compounds which can be photo-decomposed by light having wavelengths of 300 to 400 nm such as a 4-(N-(2-(2,4-di-tert-amylphenoxy)butyryl)piperazino)benzenediazonium, a 4-dioctylaminobenzenediazonium, a 4-(N-(2-ethylhexanoyl)piperazino)benzenediazonium, a 4-dihexylamino-2-hexyloxybenzenediazonium, a 4-N-ethyl-N-hexadecylamino-2-ethoxybenzodiazonium, a 2,5-dibutoxy-4-(N-(2-ethylhexanoyl)piperazino)benzenediazonium, a 2,5-diethoxy-4-(N-(2-(2,4-di-tert-amylphenoxy)butyryl)piperazino)benzenediazonium, and the compounds shown in the above-mentioned specific examples D-3 to 5. Here, the maximum absorbing wavelength of diazonium salt compounds was determined such that each of the compounds was formed into coating film of 0.1 g/m$^2$ to 1.0 g/m$^2$, and maximum absorbing wavelength of the film was measured by using a spectrophotometer (Shimadzu MPS-2000).

Examples of the coupler, which reacts with the above-mentioned diazonium salt to form color by heating and can be used in the invention, include a resorcin, a phloroglucin, a 2,3-dihydroxynaphthalene-6-sodium sulfonate, a 1-hydroxy-2-naphthoic morpholinopropylamide, a 1,5-dihydroxynaphthalene, a 2,3-dihydroxynaphthalene, a 2,3-dihydroxy-6-sulfanylnaphthalene, a 2-hydroxy-3-naphtoic anilide, a 2-hydroxy-3-naphtoic ethanolamide, a 2-hydroxy-3-naphtoic octylamide, a 2-hydroxy-3-naphtoic-N-dodecyloxypropylamide, a 2-hydroxy-3-naphtoic tetradecylamide, an acetoanilide, an acetoacetoanilide, a benzoylacetoanilide, a 2-chloro-5-octylacetoacetoanilide, a 1-phenyl-3-methyl-5-pyrazolone, a 1-(2'-octylphenyl)-3-methyl-5-pyrazolone, a 1-(2',4',6'-trichlorophenyl)-3-benzamide-5-pyrazolone, a 1-(2',4',6'-trichlorophenyl)-3-anilino-5-pyrazolone, a 1-phenyl-3-phenylacetamide-5-pyrazolone, and the following compounds C-1 to c-6. Two or more kinds of these couplers may be used in combination in order to obtain a desired coloring hue.

C-1

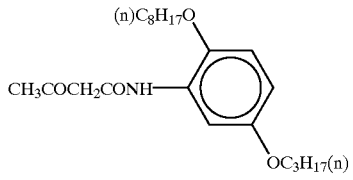

C-2

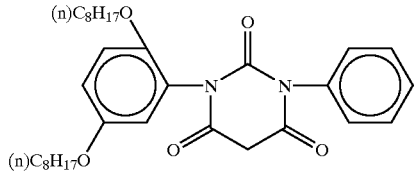

C-3

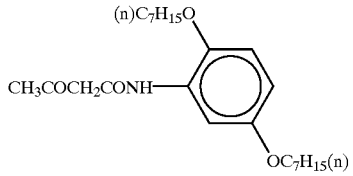

C-4

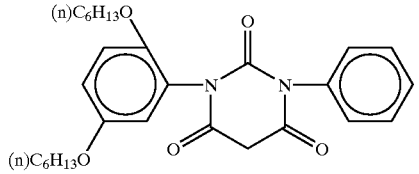

C-5

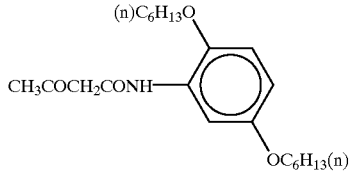

C-6

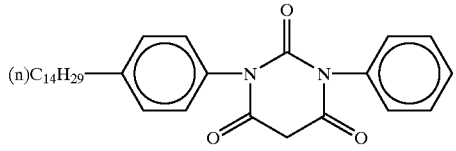

Examples of the basic substance include those compounds that are decomposed by heating to generate an alkali substance, in addition to inorganic basic compounds and organic basic compounds. Typical examples of the basic substance include nitrogen-containing compounds such as organic ammonium salts, organic amines, amides, urea and thiourea, and derivatives thereof, thiazoles, pyrroles, pyrimidines, piperazines, guanidines, indoles, imidazoles, imidazolines, triazoles, morpholines, piperidines, amidines, formazines and pyridines.

Specific examples of nitrogen-containing compounds include a tricyclohexylamine, a tirbenzylamine, an octadecylbenzylamine, a stearylamine, an allylurea, a thiourea, a methylthiourea, an allylthiourea, an ethylenethiourea, a 2-benzylimidazole, a 4-phenylimidazole, a 2-phenyl-4-methylimidazole, a 2-undecylimidazoline, a 2,4,5-trifuryl-2-imidazoline, a 1,2-diphenyl-4,4-dimethyl-2-imidazoline, a 2-phenyl-2-imidazoline, a 1,2,3-triphenylguanidine, a 1,2-dicyclohexylguanidine, a 1,2,3-tricyclohexylguanidine, a guanidinetrichloro acetate, a N,N'-dibenzylpiperazine, a 4,4'-dithiomorpholine, a morpholiniumtrichloro acetate, a 2-aminobenzothiazole, and a 2-benzoylhydrazinobenzothiazole. Two or more kinds of these compounds may be used in combination.

Microcapsules having wall films made from polyurethane polyurea resin can be manufactured through the following processes by: mixing a precursor of a microcapsule wall such as polyvalent isocyanate with a core material to be encapsulated, and emulsifying this mixture into an aqueous solution of a water-soluble high polymer such as polyvinyl alcohol, and raising a temperature thereof so that a polymer forming reaction is caused in the interface of oil-droplets with the solution.

In the method for emulsifying coloring components, at first the coloring components are dissolved in oil. This oil may be either solid or liquid at room temperature, and may be a polymer. Examples of the oils include assisting solvents having low boiling-point such as an acetate, a methylenechloride and a cyclohexanone, and a phosphate, phthalates, acrylates, methacrylates, other carboxylates, a fatty acid amide, an alkylated biphenyl, an alkylated terphenyl, an alkylated naphthalene, a diarylethane, a chlorinated paraffin, alcohol type oils, phenol type oils, ether type oils, mono-olefin type oils, and epoxy type oils.

Specific examples of the oils include high-boiling-point oils such as a tricresyl phosphate, a trioctyl phosphate, an octyldiphenyl phosphate, a tricyclohexyl phosphate, a dibutyl phthalate, a dioctyl phthalate, a dilauryl phthalate, a dicyclohexyl phthalate, a butyl olefin acid, a diethyleneglycol benzoate, a dioctyl sebacate, a dibutyl sebacate, a dioctyl adipate, a trioctyl trimellitate, an acetyltriethyl citrate, an octyl maleate, a dibutyl maleate, an isoamyl biphenyl, a chlorinated paraffin, a diisopropyl naphthalene, a 1,1'-ditolylethane, a 2,4-ditertiaryamylphenol, a N,N-dibutyl-2-butoxy-5-tertiaryoctylaniline, a hydroxybenzoate 2-ethylhexyl ester and a polyethylene glycol. Among these oils, alcohol type oils, phosphate type oils, carboxylates type oils, alkylated biphenyl, alkylated terphenyl, alkylated naphthalene and diaryl ethane are more preferably used. Moreover, an anti-carbonization agent such as hindered phenol and hindered amine may be added to the above-mentioned high-boiling-point oil. Furthermore, in particular, oils having an unsaturated fatty acid such as $\alpha$-methylstyrene dimmer are preferably used. Examples of the $\alpha$-methylstyrene dimmer include "MSD100" (trade name, manufactured by Mitsui Toatsu Chemicals, Inc.) may be used.

The solution of the oil containing the above-mentioned coloring components are added to a water solution of a water-soluble polymer, and emulsified by using a colloid mill, a homogenizer or ultrasonic wave. Polyvinyl alcohol can be used as the water-soluble polymer used in this case, and an emulsion or a latex of a hydrophobic polymer may be used in combination thereto. Examples of the water-soluble polymer include polyvinyl alcohols, silanol-denatured polyvinyl alcohols, carboxy-denatured polyvinyl alcohols, amino-denatured polyvinyl alcohols, itaconic acid-denatured polyvinyl alcohols, styrene-maleic anhydride copolymers, butadiene-maleic anhydride copolymers, ethylene-maleic anhydride copolymers, isobutylene-maleic anhydride copolymers, polyacrylamides, polystyrene sulfonic acids, polyvinyl pyrolidones, ethylene-acrylic acid copolymers, gelatin and its derivatives. Among these polymers, carboxy-denatured polyvinyl alcohols, acylated gelatins (for example, phthalated gelatins) and the like are particularly preferable. Examples of the emulsion or latex of a hydrophobic polymer include styrene-butadiene copolymers, carboxy-denatured styrene-butadiene copolymers and acrylonitrile-butadiene copolymers. Any known surfactant and the like may be added thereto, if necessary.

As the microcapsule-forming method, any conventionally known method for forming microcapsules may be used for the present invention. In other words, the microcapsules can be prepared as follows. Coloring components, which are preferably coloring components composed of a diazonium salt compound and a microcapsule wall precursor, are dissolved in an organic solvent that is hardly soluble or insoluble to water, and this solution is added to an aqueous solution of a water soluble polymer, and emulsified with, for example, a homogenizer. The emulsion is heated so that a polymer substance (the wall precursor) that will become the microcapsule walls forms wall films at the oil/water interface. Thus, the microcapsules can be prepared. Specific examples of the polymer substance that forms the wall films of the microcapsules include polyurethane resins, polyurea resins, polyamide resins, polyester resins, polycarbonate resins, aminoaldehyde resins, melamine resins, polystyrene resins, styrene-acrylate copolymer resins, styrene-methacrylate copolymer resins, gelatin and polyvinyl alcohols. Among these polymers, polyurethane resins and polyurea resins are particularly preferably used as a wall-forming material to form the microcapsules.

Specific examples of the polyvalent isocyanate compounds include diisocyanates such as m-phenylenediisocyanate, p-phenylenediisocyanate, 2,6-tolylenediisocyanate, 2,4-tolylenediisocyanate, naphthalene-1,4-diisocyanate, diphenylmethane-4,4'-diisocyanate, 3,3'-diphenylmethane-4,4'-diisocyanate, xylene-1,4-diisocyanate, 4,4,-diphenylpropanediisocyanate, trimethylenediisocyanate, hexamethylenediisocyanate, propylene-1,2-diisocyanate, butylene-1,2-diisocyanate, cyclohexylene-1,2-diisocyanate and cyclohexylene-1,4-diisocyanate, triisocyanates such as 4,4',4"-triphenylmethanetriisocyanate and toluene-2,4,6-triisocyanate, tetraisocyanates such as 4,4,-dimethylphenylmethane-2,2',5,5'-tetraisocyanate, and isocyanate prepolymers such as an adduct of hexamethylenediisocyanate and trimethylolpropane, an adduct of 2,4-tolylenediisocyanate and trimethylolpropane, an adduct of xylylenediisocyanate and trimethylolpropane, and an adduct of tolylenediisocyanate and hexanetriol. Moreover, two or more of these isocyanates may be used in combination. Among these isocyanates, those having three or more isocyanate groups in a molecular are preferably used.

In the microcapsule forming method, those oils used and described in the emulsifying process may be used as the organic solvent for dissolving the coloring components. Moreover, the water-soluble polymer may also be used. The particle size of the microcapsules is preferably 0.1 to 1.0 $\mu$m, and more preferably 0.2 to 0.7 $\mu$m.

Examples of the electron-donating dye precursor that is another preferable coloring component used in the invention include triarylmethane compounds, diphenylmethane compounds, thiazine compounds, xanthene compounds and spiropyran compounds. Among these compounds, triarylmethane compounds and xanthene compounds have a high coloring density and are preferably used. Specific examples thereof include a 3,3-bis(p-dimethylaminophenyl)-6-dimethylaminophthalide (that is, crystal violet lactone), a 3,3-bis(p-dimethylamino)phthalide, a 3-(p-dimethylaminophenyl)-3-(1,3-dimethylindole-3-yl) phthalide, a 3-(p-dimethylaminophenyl)-3-(2-methylindole-3-yl)phthalide, a 3-(o-methyl-p-diethylaminophenyl)-3-(2-methylindole-3-yl)phthalide, a 4,4'-bis(dimethylamino) benzhydrinbenzylether, a N-halophenyl leucoauramine, a N-2,4,5-trichlorophenylleucoauramine, a rhodamine-B-anilinolactam, a rhodamine(p-nitroanilino)lactam, a rhodamine-B-(p-chloroanilino)lactam, a 2-benzylamino-6-diethylaminofluoran, a 2-anilino-6-diethylaminofluoran, a 2-anilino-3-methyl-6-diethylaminofluoran, a 2-anilino-3-methyl-6-cyclohexylmethylaminofluoran, a 2-anilino-3-methyl-6-isoamylethylaminofluoran, a 2-(o-chloroanilino)-6-diethylaminofluoran, a 2-octylamino-6-diethylaminofluoran, a 2-ethoxyethylamino-3-chloro-2-diethylaminofluoran, a 2-anilino-3-chloro-6-diethylaminofluoran, a benzoylleucomethylene blue, a p-nitrobenzylleucomethylene blue, a 3-methyl-spiro-dinaphthopyran, a 3-ethyl-spiro-dinaphthopyran, a 3,3'-dichloro-spiro-dinaphthopyran, a 3-benzylspirodinaphthopyran, and a 3-propyl-spiro-dibenzopyran.

With respect to the above-mentioned electron-accepting compound, examples thereof include phenol derivatives, salicylic acid derivatives and hydroxybenzoic acid esters. In particular, bisphenols and hydroxybenzoic acid esters are preferably used. Specific examples thereof include a 2,2-bis(p-hydroxyphenyl)propane (that is, bisphenol A), a 4,4'-(p-phenylenediisopropylidene)diphenol (that is, bisphenol P), a 2,2-bis(p-hydroxyphenyl)pentane, 2,2-bis(p-hydroxyphenyl)ethane, a 2,2-bis(p-hydroxyphenyl)butane, a 2,2-bis(4'-hydroxy-3',5'-dichlorophenyl)propane, a 1,1-(p-hydroxyphenyl)cyclohexane, a 1,1-(p-hydroxyphenyl)propane, a 1,1-(p-hydroxyphenyl)pentane, a 1,1-(p-hydroxyphenyl)-2-ethylhexane, a 3,5-di(α-methylbenzyl)salicylic acid and polyvalent metal salts thereof, a 3,5-di(tert-butyl)salicylic acid and polyvalent metal salts thereof, a 3-α,α-dimethylbenzylsalicylic acid and polyvalent metal salts thereof, a p-hydroxy butyl benzoate, a p-hydroxy benzyl benzoate, a p-hydroxybenzoate-2-ethylhexyl, a p-phenylphenol and a p-cumylphenol.

With respect to the sensitizing agent, a low-melting-point organic compound which contains appropriately an aromatic group and a polarity group in a molecule is preferably used. Examples thereof include a p-benzyloxybenzyl benzoate, a α-naphthylbenzyl ether, a β-naphthylbenzyl ether, a β-naphthoic acid phenyl ester, a α-hydroxy-β-naphthoic acid phenyl ester, a β-naphthol-(p-chlorobenzyl)ether, a 1,4-butanediolphenyl ether, a 1,4-butanediol-p-methylphenyl ether, a 1,4-butanediol-p-ethylphenyl ether, a 1,4-butanediol-m-methylphenyl ether, a 1-phenoxy-2-(p-tolyloxy)ethane, a 1-phenoxy-2-(p-ethylphenoxy)ethane, a 1-phenoxy-2-(p-chlorophenoxy)ethane and a p-benzylbiphenyl.

In the invention, the above-mentioned heat-sensitive layer may be laminated, and a multi-color heat-sensitive recording material may be obtained by changing hues of each of the heat-sensitive recording layers. The layer structure is not particularly limited. However, examples of preferable multi-color heat-sensitive recording materials are described below. A preferable multi-color heat-sensitive recording material is prepared by laminating a heat-sensitive recording layer comprising a combination of an electron-donating colorless dye and an electron-accepting compound, and two heat-sensitive recording layers each including a combination of a diazonium salt compound, which has photosensitive wavelength different from that of the diazonium salt compound in the other heat sensitive recording layer, and a coupler that react by heating with the diazonium salt compound to develop a hue, which hue is different for each heat sensitive recording layer. Another preferable multi-color heat-sensitive recording material is formed by laminating three heat-sensitive recording layers each comprising a diazonium salt compound having a photosensitive wavelength different from the others and a coupler that can react by heating with the respective diazonium salt compounds to develop different hues. The latter multi-color heat-sensitive recording material is more preferable.

Moreover, a structure of the multi-color heat-sensitive recording materials, which is formed by successively providing on a support a heat-sensitive recording layer containing an electron-donating dye and an electron-accepting compound, a photo-fixing type heat-sensitive recording layer containing a diazonium salt compound having a maximum absorbing wavelength of 400±20 nm and a coupler that reacts with this diazonium salt compound to develop color, and a photo-fixing type heat-sensitive recording layer containing a diazonium salt compound having a maximum absorbing wavelength of 360±20 nm and a coupler that reacts with this diazonium salt compound to develop color, and further providing a light-transmittance adjusting layer and a protective layer thereon, is preferably used. This light-transmittance adjusting layer is formed on the heat-sensitive recording layer and reduces the light transmittance of light in a wavelength range required for a light-fixing process after the photo-fixing process. That is, the light-transmittance adjusting layer, whose transmittance of light in a wavelength range required for light fixation is reduced after fixation, may be formed on the heat-sensitive recording layer.

Furthermore, a preferably used structure of the multi-color heat-sensitive recording materials, is formed by successively providing a photo-fixing type heat-sensitive recording layer containing a diazonium salt compound having a maximum absorbing wavelength of 340±20 nm or less and a coupler that reacts with this diazonium salt compound to develop color, a photo-fixing type heat-sensitive recording layer containing a diazonium salt compound having a maximum absorbing wavelength of 360±20 nm and a coupler that reacts with this diazonium salt compound to develop color and a photo-fixing type heat-sensitive recording layer containing a diazonium salt compound having a maximum absorbing wavelength of 400±20 nm and a coupler that reacts with this diazonium salt compound to develop color on a support, and further providing a light-transmittance adjusting layer and a protective layer thereon.

In other words, on a support are formed a first heat-sensitive recording layer containing a combination of an electron-donating colorless dye and an electron-accepting compound or a combination of a diazonium salt compound having a maximum absorbing wavelength of not more than 340 nm and a coupler that reacts with this diazonium salt compound by heating to develop color, a second heat-sensitive recording layer containing a diazonium salt compound having a maximum absorbing wavelength of 360±20 nm and a coupler that reacts with this diazonium salt compound by heating to develop color and a third heat-sensitive recording layer containing a diazonium salt compound having a maximum absorbing wavelength of 400±20 nm and a coupler that reacts with this diazonium salt compound by heating to develop color. In this structure, by selecting the color-developed hues of the heat-sensitive recording layers to exhibit three primary colors in the subtractive color mixing system, namely yellow, magenta and cyan, it becomes possible to carry out a full-color image recording.

In the recording method of this multi-color heat-sensitive recording material, first, heating for the third heat-sensitive recording layer is carried out to cause the diazonium salt compound and the coupler contained in the layer to react each other and develop a color. Next, the unreacted diazonium salt compound contained in the third heat-sensitive recording layer is decomposed by applying light of 400±20 nm. Then, heat which sufficiently makes the second heat-sensitive recording layer develop a color is applied so that the diazonium salt compound and the coupler contained in the layer react with each other to develop the color. At this time, although the third heat-sensitive recording layer is simultaneously heated strongly, the unreacted diazonium salt compound in the third heat-sensitive recording layer has already been decomposed and lost its color developing capability, therefore it does not develop a color. Moreover, light of 360±20 nm is applied in order to decompose the diazonium salt compound contained in the second heat-sensitive recording layer. Then, heat which sufficiently makes the first heat-sensitive recording layer develop a color is applied thereto so as to develop the color. At this time, although the third and second heat-sensitive recording layers are simultaneously heated strongly, the unreacted diazonium salt compounds therein have been decomposed and lost their color developing capability and do not develop the colors.

Moreover, the following known antioxidants are preferably used in the invention, in order to further improve the light fastness. Examples of the antioxidants include those described in European Patent Publication No. 310,551, German Patent Publication No. 3,435,443, European Patent Publication No. 310,552, JP-A No. 3-121449, European Patent Publication No. 459416, JP-A Nos. 2-262654, 2-71262, 63-163351, U.S. Pat. No. 4,814,262, JP-A Nos. 54-48535, 5-61166, 5-119449, U.S. Pat. No. 4,980,275, JP-A Nos. 63-113536, 62-262047, and European Patents Publication Nos. 223,739, 309,402, 309,401. Specific examples thereof include the following compounds.

Q-1

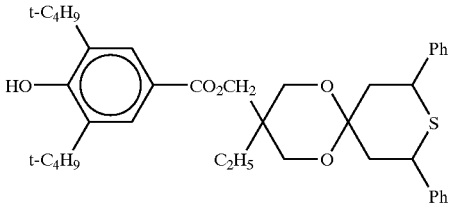

Q-2

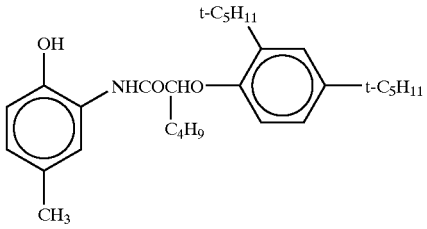

Q-3

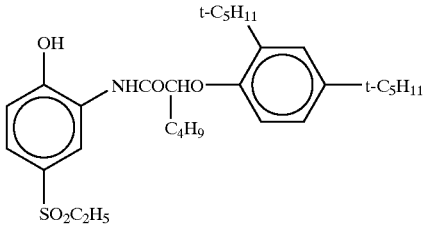

-continued

Q-4

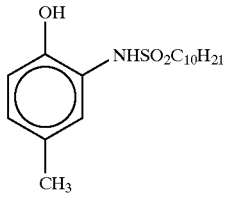

Q-5

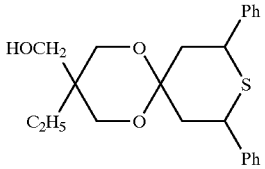

Q-6

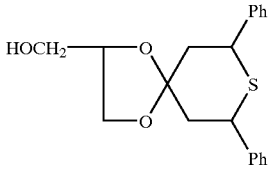

Q-7

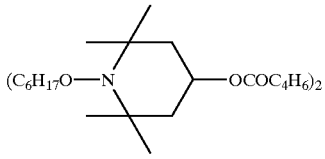

and

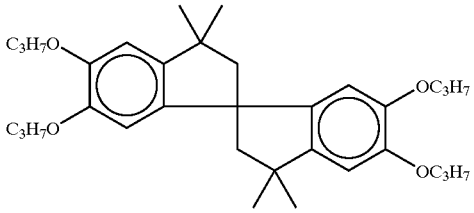

Q-8

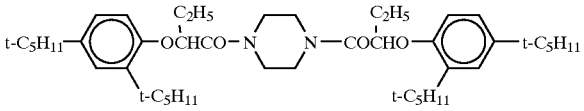

Q-9

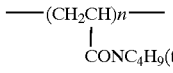

Q-10

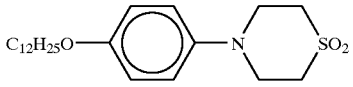

Q-11

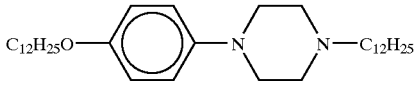

Q-12

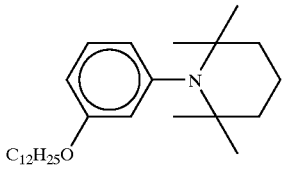

-continued
Q-13
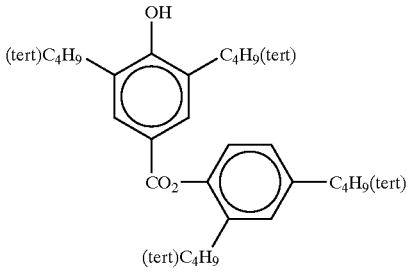
Q-14
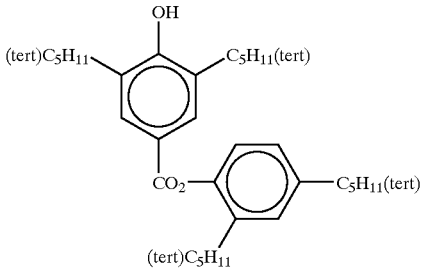
Q-15
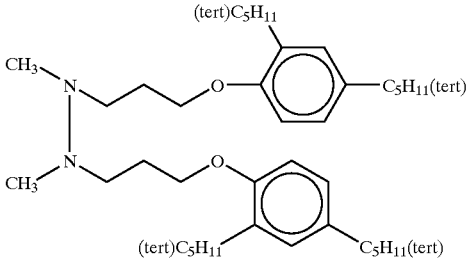
Q-16
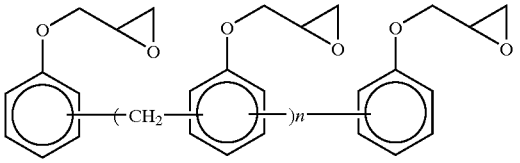
Q-17
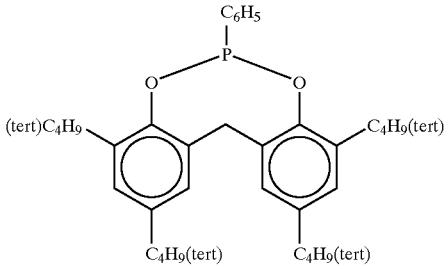
-continued
Q-18
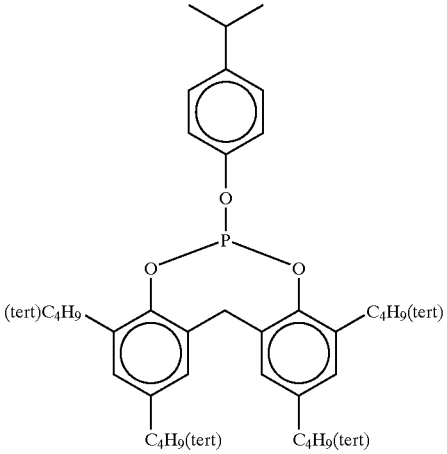
Q-19
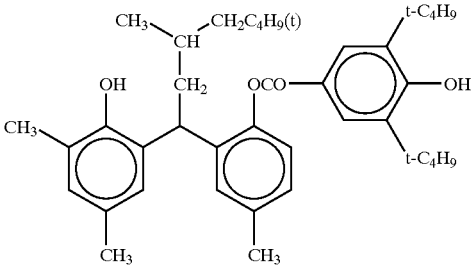
Q-20
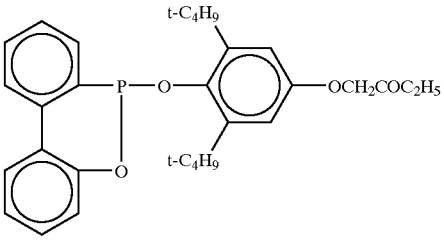
Q-21
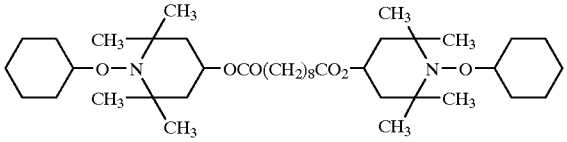
Q-22
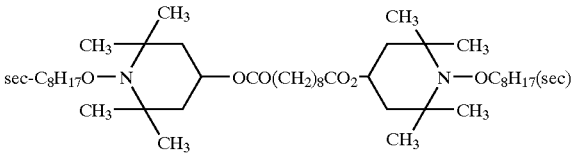
Q-23
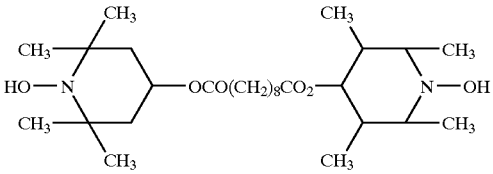
Q-24
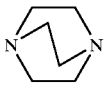

-continued

Q-25

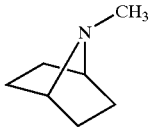

Q-26

$(C_{14}H_{27}OCOCH_2CH_2)_2S$

Q-27

$(C_{18}H_{37}OCOCH_2CH_2)_2S$

Q-28

$(C_{12}H_{25}SCH_2CH_2CO_2CH_2)_4C$

In the invention, the light-transmittance adjusting layer contains a component that functions as a precursor of an ultraviolet ray absorbing agent. This component does not function as the ultraviolet ray absorbing agent before a light having wavelength which is in a wavelength range required for a fixing process is irradiated. Therefore, the light-transmittance adjusting layer has a high light transmittance, and light, which is in the wavelength range required for the fixing process when the light fixing type heat-sensitive recording layer is fixed, can be sufficiently transmitted. Further, the layer also has a high transmittance in visible light rays, and causes no adverse effects on the fixing process of the heat-sensitive recording layer.

After irradiation of light which is in the wavelength range required for the fixing process of the light fixing type heat sensitive recording layer, this precursor of the ultraviolet ray absorbing agent is reacted by light, heat or the like, and begins to function as the ultraviolet ray absorbing agent. Thus, the ultraviolet ray absorbing agent is formed, and most ultraviolet light among light in the wavelength range required for the fixing is absorbed by the ultraviolet ray absorbing agent. In this way, a reduction in the transmittance is caused so that light fastness of the heat-sensitive recording material is improved. The transmittance of visible light rays is substantially unchanged since there is no absorbing effect for visible light rays.

At least one layer of the light-transmittance adjusting layer may be formed in the light fixing type heat-sensitive recording material. It is most preferable to form this layer between the light fixing type heat-sensitive recording layer and the outermost protective layer, or this light-transmittance adjusting layer may comprise a function of a protective layer. The characteristics of the light-transmittance adjusting layer may be desirably selected in accordance with the characteristics of the light fixing type heat-sensitive recording layer.

The heat-sensitive recording material, to which the invention is particularly and effectively applied, is particularly preferably prepared by providing a light-fixing type heat-sensitive recording layer which contains at least a diazonium salt compound having a maximum absorbing wavelength of 360±20 nm and a coupler that reacts with this diazonium salt compound to develop color and a light-fixing type heat-sensitive recording layer which contains a diazonium salt compound having a maximum absorbing wavelength of 400±20 nm and a coupler that reacts with this diazonium salt compound to develop color on a support, and further providing a light-transmittance adjusting layer on the layers. In the case of the heat-sensitive recording material, it is preferable that the light transmittance of the light-transmittance adjusting layer with respect to light in the wavelength range used for light-fixing is not less than 65% at 360 nm, and is not more than 20% at 360 nm after the fixing process (irradiation of light). In this case, the irradiation of light refers to an irradiation of light of 13 kJ/m$^2$ with a wavelength of 420 nm which is provided by a xenon lamp forced tester. More specifically, it refers to a light irradiation at 0.9 W/m$^2$ for 4.0 hours given by Weather Ometer Ci65 (made by Atlas Electric Co.).

Moreover, the invention is also preferably applied to the recording material which is provided with a light-fixing type heat-sensitive recording layer which contains a diazonium salt compound having a maximum absorbing wavelength of less than 340 nm and a coupler that reacts with this diazonium salt compound to develop color and a light-fixing type heat-sensitive recording layer which contains a diazonium salt compound having a maximum absorbing wavelength exceeding 420 nm and a coupler that reacts with this diazonium salt compound to develop color.

Furthermore, by changing the hues of the respective heat-sensitive recording, it is possible to obtain a multi-color heat-sensitive recording material. In other words, by selecting the coloring hues of the respective heat-sensitive recording layers so as to form the three primary colors of yellow, magenta and cyan in the subtractive color mixing system, it becomes possible to carry out a full-color image recording process. In this case, with respect to a color-developing mechanism of a heat-sensitive recording layer directly laminated on a support (the lowest layer of the heat-sensitive recording layers), any of color-developing systems such as a color-developing system based on a combination of an electron-donating dye and an electron-accepting dye, a diazo color-developing system based on a combination of a diazonium salt and a coupler that reacts with this diazonium salt to develop color, a base color-developing system that develops colors upon contact with a basic compound, a chelate color-developing system, and a color-developing system in which a reaction with a nucleophile agent cause an elimination reaction to develop colors, maybe adopted. Among these systems, the diazo color-developing system is preferably used. Therefore, on this heat-sensitive recording layer having the diazo color-developing system, two light fixing type heat-sensitive recording layers respectively containing diazonium salt compounds having different maximum absorbing wavelengths and couplers that react with these diazonium salt compounds to develop colors are preferably formed, with a light-transmittance adjusting layer and an outermost protective layer being successively formed on the heat-sensitive recording layers.

A precursor of an ultraviolet ray absorbing agent described on pages 11 to 15 of JP-A No. 7-276808 may be used as a compound contained in the light-transmittance adjusting layer of the present invention.

The above-mentioned precursor does not absorb the fixing light when a heat-sensitive recording material is fixed, and then, when light is applied thereto after an image formation, the ultraviolet ray absorbing agent is formed and absorbs ultraviolet rays having longer wavelengths than the fixing light, thereby making it possible to improve the light stability of the image.

Examples of methods that use the compound contained in the light-transmittance adjusting layer include those for the aforementioned color-developing components, such as (i) a method in which the compound is solid-state dispersed and used, (ii) a method in which the compound is emulsion-dispersed and used, (iii) a method in which the compound is polymer-dispersed and used, (iv) a method in which the compound is latex-dispersed and used, and (v) a method in which the compound is formed into microcapsules and used. Among these methods, the method in which it is formed into microcapsules and used is preferably adopted.

The compound may be contained in a protective layer in order to provide a function of a light-transmittance adjusting layer to the protective layer in addition to a function of the protective layer, or the compound may be contained in a light-transmittance adjusting layer which is placed separately from the protective layer. When a protective layer or a light-transmittance adjusting layer containing the compound is formed, the coating amount of the compound is preferably not less than 0.35 g/m$^2$, and more preferably 0.35 to 1.5 g/m$^2$. In this case, the coating amount less than 0.35 g/m$^2$ causes difficulties in the light-transmittance adjusting functions. In particular, it causes difficulties in reducing the light transmittance in the ultraviolet ray range after the light irradiation in a wavelength range required for the fixing process has been completed, and results in a reduction in light resistance. In contrast, the coating amount exceeding 1.5 g/m$^2$ tends to cause a deterioration of the light-transmittance adjusting function, in particular a deterioration of a light transmittance before the light irradiation in a wavelength range required for the fixing process, and is liable to cause problems of the fixing property.

With respect to the method of emulsion method and the capsule-forming method for the compound, the same methods for the color-developing components described above may be also used.

In the present invention, in order to further reduce coloring caused by fading due to light, a compound known as a reducing agent may be used together with the precursor of the above-mentioned ultraviolet ray absorbing agent. This reducing agent may be located inside the microcapsules or outside the microcapsules when microcapsules are utilized. In the case when the reducing agent is located outside the microcapsules, the reducing agent enters the microcapsules when the microcapsules are heated for printing. Examples of an additive as the reducing agent include hydroquinone compounds, hydrazide compounds, hydroxyl compounds, phenidone compounds, catechol compounds, resorcinol compounds, hydroxylhydroquinone compounds, pyroroglycinol compounds, phenol compounds, phenylhydrazide compounds, gallic acid compounds, ascorbic acid compounds and ethylene glycol compounds. These compounds are disclosed in JP-A Nos. 3-191341, 3-25434, 1-252953, 2-302753, 1-129247, 1-227145, 1-243048 and 2-262649. Specific examples thereof include N-phenylacetohydrazides, N-phenylbutyrylhydrazides, p-t-butylphenols and 2-azidebenzoxazoles.

The heat-sensitive recording layer of the invention can effectively use and comprise various additives that are already known as heat-sensitive recording materials and pressure-sensitive recording materials. Examples thereof include antioxidants described in JP-A Nos. 60-125470, 60-125471, 60-125472, 60-287485, 60-287486, 60-287487, 62-146680, 60-287488, 62-282885, 63-89877, 63-88380, 63-088381, 01-239282, 04-291685, 04-291684, 05-188687, 05-188686, 05-110490, 05-1108437, 05-170361, 63-203372, 63-224989, 63-267594, 63-182484, 60-107384, 60-107383, 61-160287, 61-185483, 61-211079, 63-251282, 63-051174, Japanese Patent Application Publications (JP-B) Nos. 48-043294 and 48-033212.

Specific examples of these antioxidants include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanoate, 2,2-bis-4-hydroxyphenyl propane, 1,1-bis-4-hydroxyphenyl-2-ethylhexane, 2-methyl-4-methoxy-diphenylamine, 1-methyl-2-phenylindole and compounds shown below:

Q-29

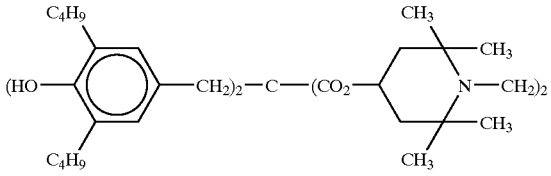

Q-30

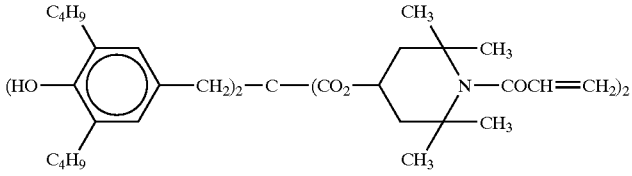

Q-31

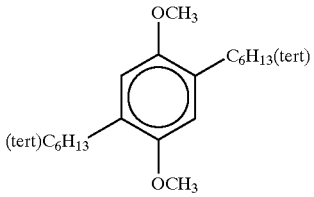

Q-32

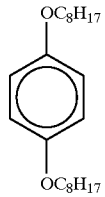

-continued
Q-33
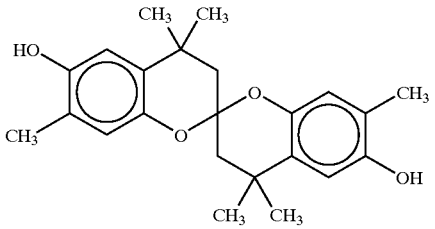
Q-34
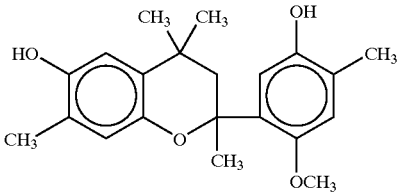
Q-35
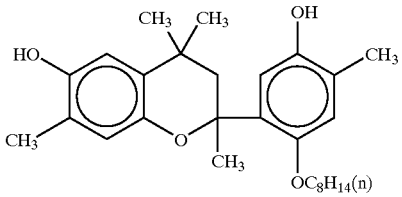
Q-36
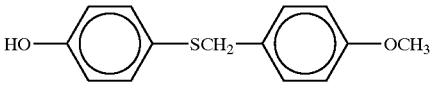
Q-37
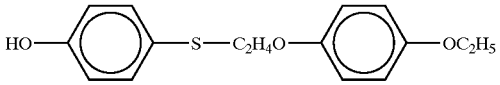
Q-38
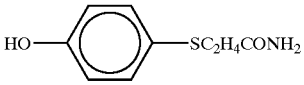
Q-39
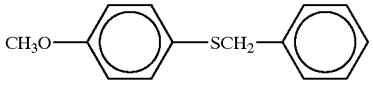
Q-40
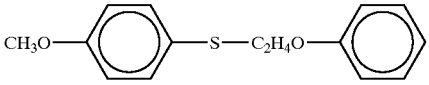
Q-41
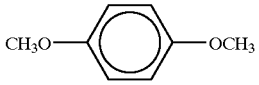
Q-42
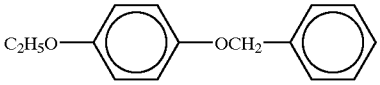
Q-43
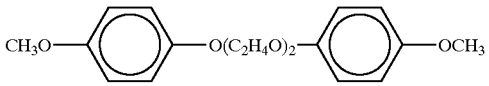
Q-44
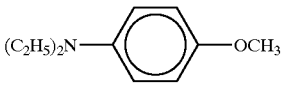
Q-44
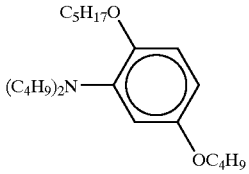
the combined use of
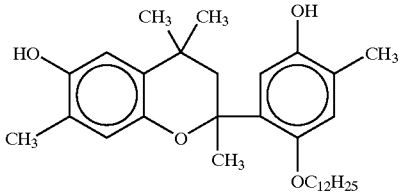
and
Q-45
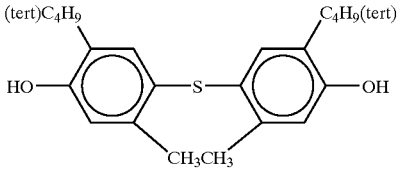
the combined use of
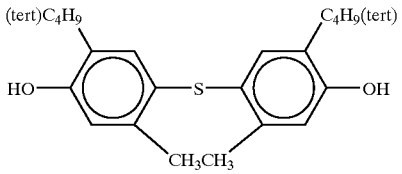
Q-46
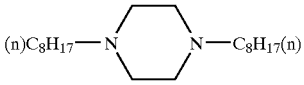
Q-47
and hydroquinone ether -continued
Q-48
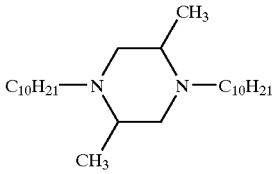
Q-49
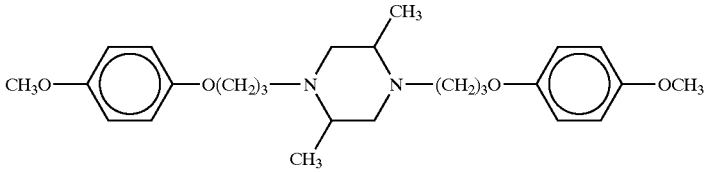
Q-50
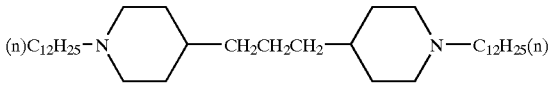
Q-51
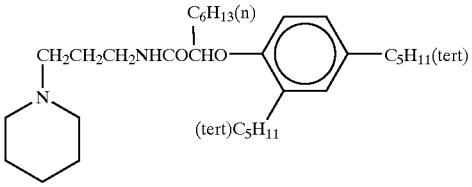
Q-52
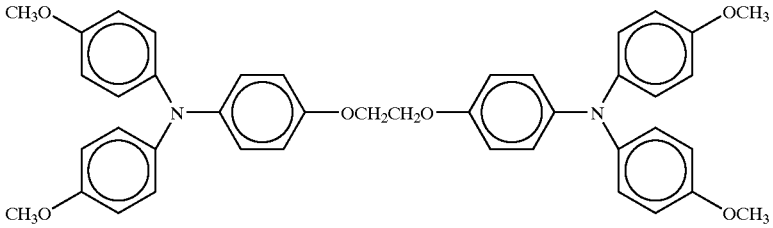
Q-53
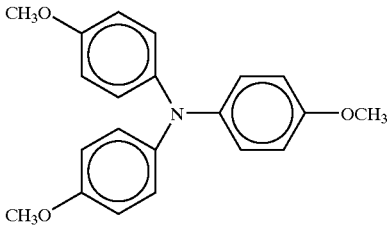
Q-54
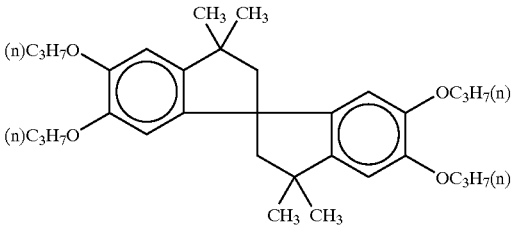
Q-55
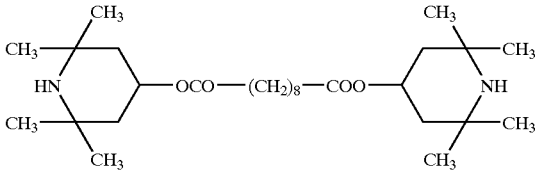
Q-56
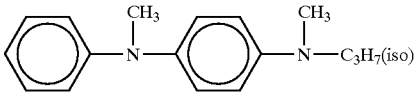
Q-57
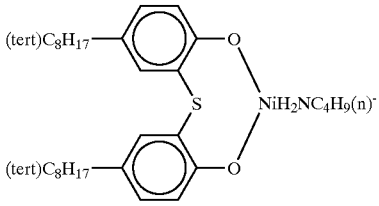
Q-58
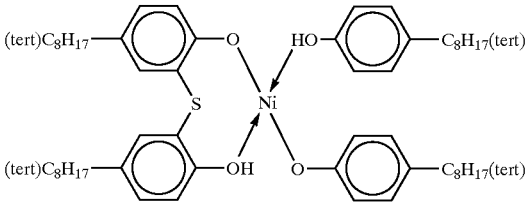

These antioxidants may be added to at least one of a heat-sensitive recording layer, an intermediate layer, a light-transmittance adjusting layer and a protective layer. Examples of when these antioxidants are used in combination include combinations of compounds (Q-7), (Q-45) and (Q-46) and combinations of compound (Q-10) and compound (Q-13).

Examples of the support used in the present invention include plastic films, paper, paper laminated with plastic resin and synthetic paper.

In the present invention, in the case when heat-sensitive recording layers having different hues are laminated, an intermediate layer may be placed in order to prevent problems such as colors mixing. When those materials having a high $O_2$ permeability such as laminated paper are used as the support, an undercoat layer may be placed as an $O_2$ cutting layer so as to improve light fastness. Water soluble polymer compounds may be used for the intermediate layer and the undercoat layer. Examples thereof include polyvinyl alcohols, denatured polyvinyl alcohols, methylcelluloses, polystyrene sodium sulfonates, styrene-maleic acid copolymers and gelatin.

With respect to the intermediate layer and the undercoat layer, it is effective for the layers to comprise a swelling inorganic laminar compound disclosed in JP-A No. 8-282112, in order to prevent color mixing and to improve light fastness while achieving a thinner layer.

In the present invention, in a case of an application where gloss-applying property is required, it is possible to provide sufficient abrasion resistance and oil resistance without using an organic or inorganic pigment in the protective layer. However, depending on an application required, any general organic or inorganic pigments may be used in the protective layer. Specific examples thereof include calcium carbonates, aluminum hydroxides, barium sulfates, titanium oxides, talcs, agalmatolites, kaolins, calcined kaolins, amorphous silicas, urea formarine resin powders, polyethylene resin powders and benzoguanamine resin powders. These pigments may be used singly, or in combinations of two or more.

The protective layer coating solution of the invention may comprise a coat-film forming polymer such as polyvinyl alcohol and a silicone denatured polymer disclosed in JP-A No. 9-83052, and if necessary, materials such as a dispersion solution of the above-mentioned pigment, a cross-linking agent, a catalyst, a mold-releasing agent, a surfactant, wax and a water repellent agent. The resulting protective layer coating solution is applied onto the heat-sensitive recording layer by using a device such as a bar coater, an air knife coater, a blade coater and a curtain coater, and dried to obtain a protective layer of the invention. Here, the protective layer may be coated simultaneously with the recording layer, or after the heat-sensitive recording layer has been coated and dried, the protective layer may be coated thereon. The dried coating amount of the protective layer is preferably 0.1 to 3 $g/m^2$, and more preferably, 0.3 to 1.5 $g/m^2$. When the coating amount is too large, there is serious deterioration in the heat sensitivity, and when the coating amount is too small, the protective layer fails to exert functions as a protective layer (abrasion resistance, lubricity, scratch resistance and the like). After the protective layer has been coated, this layer may be subjected to a calender process, if necessary.

In the above-mentioned examples, a full-color heat-sensitive recording layer has been particularly explained. However, a heat-sensitive recording material having a mono-color heat-sensitive recording layer is also comprised in the scope of the present invention.

EXAMPLES

The present invention will be described by using the following examples and comparative examples. However, the invention is not intended to be limited thereto. Here, in the following description, "parts" refers to "parts by weight", unless otherwise described.

Comparative Example 1

Preparation of Solution for Heat-sensitive Recording Layer

Preparation of Diazonium Salt Compound Capsule Solution

As a diazonium salt compound, 2.8 parts of a compound that is represented by the following general formula a-1 and has a maximum absorbing wavelength of decomposition at 365 nm, 2.8 parts of dibutyl sulfate and 0.56 parts of 2,2-dimethoxy-1,2-diphenylethane-1-on (trade name: "Irugacure 651", manufactured by Chiba Geigy Corporation) were dissolved in 19.0 parts of ethylacetate. Further, 5.9 parts of isopropylbiphenyl that is a high boiling point solvent and 2.5 parts of tricresyl phosphate were added to the above-mentioned solution, and heated and mixed uniformly. To this solution was further added 7.6 parts of xylylenediisocyanate/trimethylol propane adduct (75% ethylacetate solution, trade name: "Takenate D110N" manufactured by Takeda Chemical Industries, Ltd.), which served as a capsule wall forming agent, and stirred uniformly. Separately, 64 parts of aqueous solution comprising 6% by weight of a gelatin trade name:, "MGP-9066" manufactured by Nippi Gelatin Industries, Ltd.) in which 2.0 parts of aqueous solution containing 10% by weight of dodecylsodiumsulfonate had been added was prepared, the above-mentioned diazonium salt compound solution was added to this mixture and emulsified using a homogenizer. 20 parts of water was added to the resulting emulsion solution and then homogenized, and this was then heated to 40° C. while being stirred, and a capsule-forming reaction was carried out for three hours. Then, the solution temperature was lowered to 35° C., and to this was further added 6.5 parts of ion-exchanged resin ("Amberlite IRA68" manufactured by Organo Corporation) and 13 parts of "Amberlite IRC50" (manufactured by Organo Corporation), and this was further stirred for 1 hour. Thereafter, the ion-exchanged resin was filtered to obtain a target capsule solution. The average particle size of the capsules was 0.64 $\mu$m.

a-1

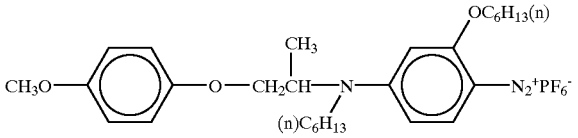

Preparation of Coupler Emulsified Dispersion Solution

The following components were dissolved in 10.5 parts of ethylacetate: 3.0 parts of a compound represented by the following general formula b-1 serving as a coupler, 4.0 parts of triphenylguanidine, 4.0 parts of 1,1-(p-hydroxyphenyl)-2-ethylhexane, 8.0 parts of 4,4'-(p-phenylenediisopropylidene)diphenol, 8.0 parts of 2-ethylhexyl-4-hydroxybenzoate, 2.0 parts of a compound represented by the following general formula b-2 serving as an antioxidant, 2.0 parts of 1,1,3-tris(2-methyl-4-hydroxy-5-t-butylphenyl)butane, and to this mixture 0.48 parts of tricresyl phosphate serving as a high-boiling-point solvent, 0.24 parts of diethyl maleate and 1.27 parts of "Poinin A41C" (manufactured by Takemoto Oil&Fat Co., Ltd.) were further added, and then heated and mixed uniformly. This was added to 93 parts of an aqueous solution containing 8% by weight of gelatin (trade name: "#750 gelatin", manufactured by Nitta Gelatin Inc.), and emulsified using a homogenizer. The residual ethylacetate was evaporated from this emulsion solution to obtain a target emulsified solution.

b-1

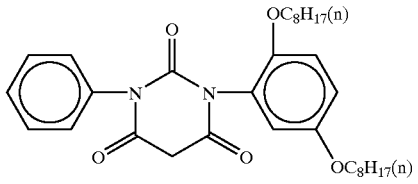

b-2

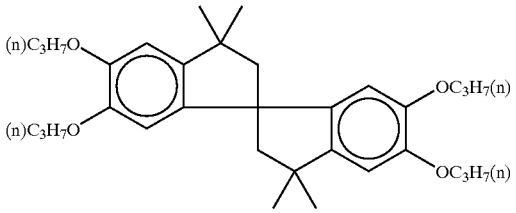

Preparation of Coating Solution

While the above-mentioned diazonium salt compound capsule solution was stirred at 40° C., a core/shell type latex was added thereto such that the ratio of diazonium salt compound/latex solid component was set to 1/6.4. The core/shell type latex had a core/shell ratio of 50/50, and comprised a styrene/butadiene copolymer (37/63) serving as a core portion and styrene/2-acetoacetoethylmethacrylate (84/16) serving as a shell portion. Into this the coupler emulsion which was dissolved at 40° C. was further mixed such that the ratio of diazonium salt compound/coupler was set to 1/2. Thus, coating solution 101 of comparative example 1 was prepared.

Comparative Example 2

Coating solution 102 of Comparative Example 2 was prepared in the same manner as in Comparative Example 1 except that the core/shell type latex of Comparative Example 1 was not added.

Example 1

Coating solution 103 of example 1 was prepared in the same manner as in Comparative Example 1, except that an aqueous solution containing 10% by weight of the compound (1), which is represented by the above-mentioned general formula (I) and having R=(S-1), n=12, was added in advance and mixed in the diazonium salt compound capsule solution of Comparative Example 1 such that the ratio of capsule solid component/compound (1) was set to 1/0.1.

Example 2

Coating solution 104 of Example 2 was prepared in the same manner as in Comparative Example 1 except that the compound (1) of the invention was preliminarily added and mixed in the core/shell type latex of Comparative Example 1 such that the ratio of capsule solid component/compound (1) was set to 1/0.1.

Example 3

Coating solution 105 of Example 3 was prepared in the same manner as in Comparative Example 1 except that an aqueous solution containing 10% by weight of the compound (1) of the invention was preliminarily added and mixed in each of the diazonium salt compound capsule solution and the core/shell type latex so that 10% by weight of the compound (1) was respectively added thereto based on solid components conversion.

Example 4

Coating solution 106 of Example 4 was prepared in the same manner as in Comparative Example 2 except that the compound (1) of the invention was preliminarily added to and mixed in the capsule solution of the diazonium compound such that the ratio of capsule solid component/compound (1) was set to 1/0.1.

Determination of Particle Size

The coating solutions prepared as described above were stirred for one hour in a thermostat at 40° C., and the particle size distribution, the average particle size and the maximum particle size of the resulting capsules were measured by a laser scattering particle size distribution analyzer "LA700" (made by Horiba Seisakusho). The results are shown in Table 1.

TABLE 1

| | Coating Solution No. | Average Particle Size (μm) | Maximum Particle Size (μm) |
|---|---|---|---|
| Comparative Example 1 | 101 | 18.00 | 62.00 |
| Comparative Example 2 | 102 | 1.89 | 4.95 |
| Example 1 | 103 | 1.03 | 1.98 |
| Example 2 | 104 | 0.99 | 2.22 |
| Example 3 | 105 | 0.85 | 1.52 |
| Example 4 | 106 | 0.72 | 1.35 |

Example 5

| Preparation of Protective Layer Solution | |
|---|---|
| Gelatin (10% by weight) | 100 g |
| Water | 50 g |
| X-22-8053 (40% by weight, a polymer described below and manufactured Shin-Etsu Chemical Co., Ltd.) | 50 g |
| Surfactant-1 (2% by weight) | 5 ml |
| Surfactant-2 (5% by weight) | 5 ml |

The above-mentioned components were mixed uniformly to prepare a target coating solution.

The aforementioned X-22-8053 is a silicone graft acrylic polymer (Tg=110° C.) represented by the following general formula.

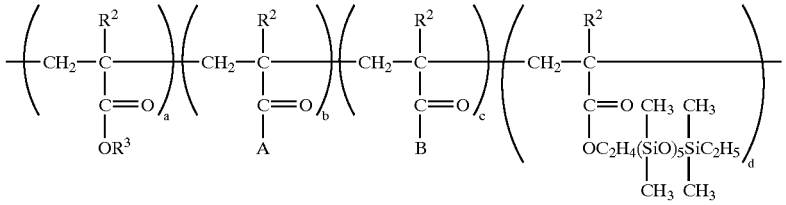

$R^2$: H, $CH_3$ $R^3$: alkyl group

A: hydrophilic group

B: reactive group

Moreover, surfactant-1 and surfactant-2 are respectively have the following structural formulas.

Surfactant-1

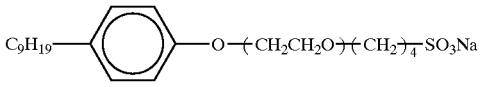

Surfactant-2

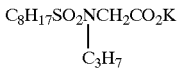

UVC-1

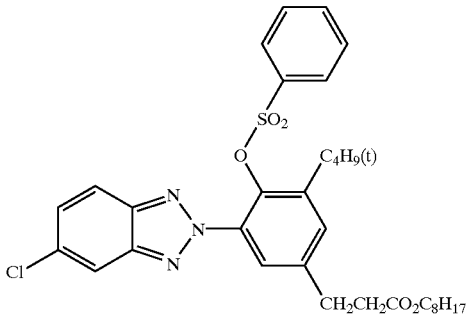

R-6

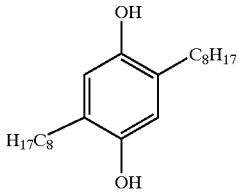

Preparation of Coating Solution of Light-transmittance Adjusting Layer 1.5 parts of compound (UVC-1, represented by the following general formula), 0.5 parts of R-6 serves as a reducing agent (represented by the following general formula), 6.0 parts of ethylacetate and 0.8 parts of tricresyl phosphate were mixed, and sufficiently dissolved. To this solution was added 3.0 parts of xylylenediisocyanate/trimethylol propane serving as a capsule wall agent (75% ethylacetate solution, "Takenate D110N" (trade name) manufactured by Takeda Chemical Industries, Ltd.), and stirred uniformly. 29.7 parts of an aqueous solution comprising 8% by weight of carboxy-denatured polyvinyl alcohol ("KL-318" (trade name), manufactured by Kuraray Co., Ltd.) was prepared, and this was added to the above-mentioned solution, and emulsified by using a homogenizer. The resulting emulsion solution was added to 40 parts of ion exchanged water, and stirred for 3 hours at 40° C. so that a capsule-forming reaction was carried out. Thereafter, 7.0 parts of ion exchanged resin "Amberlite MB-03" (trade name, manufactured by Organo Corporation) was added thereto, and further stirred for an hour. Thus, a target coating solution was prepared. The average particle size of the capsules was 0.35 $\mu$m.

Preparation of Support

Wood pulp comprising 100 parts of LBKP was beaten and decomposed by a double disk refiner to obtain 300 cc of Canadian freeness, and to this were added 0.5 parts of epoxidized behenic acid amide, 1.0 part of anion polyacrylic amide, 0.1 parts of polyamidepolyamine epichlorohydrine and 0.5 parts of cation polyacrylamide at an absolute dry weight ratio. Then, using a fourdrinier paper machine, a base paper having a basic weight of 100 g/$m^2$ was formed, and a surface of the paper was sized with polyvinyl alcohol applied thereto at an absolute dry weight of 1.0 g/$m^2$, and this was adjusted to a density of 1.0 through a calender treatment.

After a corona discharging treatment had been carried out on a wire face side of the paper (back surface), the surface was coated by using a melting extruder with high density polyethylene at a resin thickness of 30 $\mu$m. In this way, a resin layer having a mat surface was formed (this surface is referred to as a back surface). After a corona discharging process had been carried out on the polyethylene coated surface as the back surface, an antistatic agent which was formed by dispersing aluminum oxide ("Alumina Sol 100" manufactured by Nissan Chemical Industries, Ltd.) and silicon dioxide ("Snowtex O" manufactured by Nissan Chemical Industries, Ltd.) at a weight ratio of 1:2 into a water, was applied thereto in an amount of dry weight of 0.2 g/m$^2$ (this is referred to as a rear PE-laminated product).

Moreover, a corona discharging treatment was carried out on a felt face (face surface) of the paper, and a melting extrusion coating was carried out on the felt face by using a melting extruder to form a coating of low-density polyethylene, which contains 10% by weight of titanium dioxide and a slight amount of ultramarine, with a resin thickness of 40 $\mu$m so that a resin layer having a gloss surface (referred to as a front face) was formed. Then, a corona discharging process was carried out on the polyethylene coated face of the front face, and a gelatin undercoating was formed thereon so as to have a dry weight of 0.1 g/m$^2$. In this way, the supports were prepared.

Preparation of Heat-sensitive Recording Material

Heat-sensitive recording materials 101 to 106 were prepared such that coating solutions 101 to 106, which were prepared in Comparative Examples 1, 2 and Examples 1 to 4, were respectively applied on the above-mentioned supports using a wire bar so as to have an amount of 8 g/cm$^2$ as a solid component, and then the above-mentioned solutions for the light-transmittance adjusting layer and protective layer were successively applied thereon in amounts of 2.5 g/m$^2$ and 1.25 g/m$^2$ respectively as solid components.

Printings of each heat-sensitive recording material formed as described above were carried out with a thermal head of KST-type manufactured by Kyocera Corporation such that an applied power and a pulse width to the thermal head were set to provide recording energy of 62 mJ/mm$^2$ per unit area. As a result, magenta color was developed thereon. Next, the heat-sensitive recording materials were fixed by light irradiation for 15 seconds with a UV lamp having a luminescence center wavelength of 365 nm and an output power of 40 w.

Evaluation Method

Glossiness: Measurement was carried out with a digital deformation gloss meter "UGV-50" made by Suga Test Instrument Co., Ltd. at an incident angle of 75°.

Granularity of images: evaluations of images were carried out through visual observations and levels A to C were determined.

A: Image was uniform.

B: Granular state was observed.

C: Extremely coarse granular state was observed.

Table 2 shows the results of the evaluations.

TABLE 2

| Heat-Sensitive Recording Material | Glossiness | Granularity |
|---|---|---|
| 101 (Comparative Example 1) | 4.8 | C |
| 102 (Comparative Example 2) | 13.2 | B |
| 103 (Example 1) | 48.2 | A |
| 104 (Example 2) | 48.5 | A |
| 105 (Example 3) | 58.2 | A |
| 106 (Example 4) | 65.0 | A |

As clearly shown in Table 2, any of the heat-sensitive recording materials of the invention have superior gloss with excellent granularity, thereby making it possible to provide uniform superior images.

Example 6, Comparative Example 3

(1) Preparation of a Cyan Heat-sensitive Recording Layer Solution

Preparation of a Capsule Solution Containing an Electron-donating Dye Precursor (i) Solution A After 5 parts of 3-(o-methyl-p-dimethylaminophenyl)-3-(1'-ethyl-2'-methylindole-3-yl)phthalide (electron-donating dye precursor) had been dissolved in 20 parts of ethylacetate, 20 parts of alkylnaphthalene (high boiling point solvent) was added thereto, and heated and mixed uniformly.

To the resulting solution was added 20 parts of adduct of xylylenediisocyanate/trimethylol propane (a ratio thereof is 1:3), and stirred uniformly to prepare the solution A.

(ii) Solution B

To 54 parts of aqueous solution comprising 6% by weight of phthalated gelatin was added 2 parts of aqueous solution comprising 2% by weight of dodecyl sodium sulfonate to prepare solution B.

Solution A was added to solution B, and they were emulsified by using a homogenizer to obtain an emulsified dispersion solution. Further, to the resulting emulsified dispersion solution was added 68 parts of water, and mixed uniformly. The mixed solution was then heated to 50° C. while being stirred, and a capsule-forming reaction was carried for 3 hours so that the microcapsules would have the average particle diameter of 1.2 $\mu$m. Thus a capsule solution was obtained.

Preparation of Color-developer Emulsified Dispersion Solution

In 10 parts of ethylacetate were dissolved the following: 2.5 parts of 1,1-(p-hydroxyphenyl)-2-ethylhexane (color-developer), 0.3 parts of tricresyl phosphate and 0.1 parts of diethyl maleate. The resulting solution was poured into a mixed solution which was obtained by mixing 20 parts of aqueous solution comprising 6% by weight of gelatin and 2 parts of aqueous solution of 2% by weight of dodecyl sodium sulfonate, and emulsified for 10 minutes by using a homogenizer to obtain an emulsified dispersion solution.

Preparation of Coating Solution

An aqueous solution of 10% by weight of the above-mentioned compound (1) of the invention was added to the capsule solution containing the electron-donating dye precursor prepared as described above such that the ratio of capsule solid components to compound (1) is 1:0.1. Then, the color-developer emulsified dispersion solution was mixed in the capsule solution containing the electron-donating dye precursor such that the weight ratio of the color-developer emulsified dispersion solution to the capsule solution equaled 4. Thus, coating solution 201(C) of Example 6 was obtained.

For comparison, coating solution 202(C) of Comparative Example 3 was prepared in the same manner as in Example 6 except that the above-mentioned compound (1) was not added.

(2) Preparation of Magenta Heat-sensitive Recording Layer Solution

Preparation of Capsule Solution Containing Diazo Compound 2.0 parts of diazo compound (1) represented by the following general formula (which is decomposed by light having a wavelength of 365 nm) was dissolved in 20 parts of ethylacetate, and to this was further added 20 parts of alkylnaphthalene, and the resulting mixture was heated and mixed uniformly. To the resulting solution was added 15 parts of adduct of xylylenediisocyanate/trimethylol propane (ratio thereof is 1:3) (capsule wall forming agent), and stirred uniformly to prepare a solution of a diazo compound.

The resulting solution of a diazo compound was added to a solution, which had been formed by mixing 54 parts of aqueous solution comprising 6% by weight of phthalated gelatin and 2 parts of aqueous solution of 2% by weight of dodecyl sodium sulfonate, and emulsified and dispersed by using a homogenizer.

To the resulting emulsified dispersion solution was added 68 parts of water, and this was mixed uniformly, and heated to 40° C. while being stirred and a capsule-forming reaction was carried out for 3 hours so that the capsules having the average particle size of 1.2 μm were formed. Thus, a capsule solution was obtained.

Diazo compound (1)

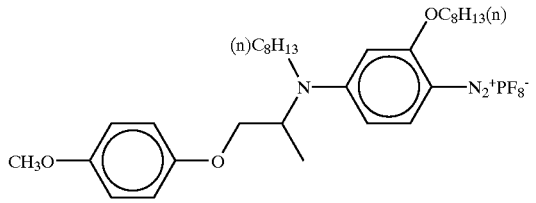

Preparation of Coupler Emulsified Dispersion Solution 2 parts of coupler (1) represented by the following general formula, 2 parts of 1,2,3-triphenylguanidine, 0.3 parts of tricresyl phosphate and 0.1 parts of diethyl maleate were dissolved in 10 parts of ethylacetate. The resulting solution was poured into a mixed solution formed by mixing 20 parts of aqueous solution comprising 6% by weight of gelatin and 2 parts of aqueous solution comprising 2% by weight of dodecyl sodium sulfonate, and emulsified for 10 minutes using a homogenizer to prepare an emulsified dispersion solution.

Coupler (1)

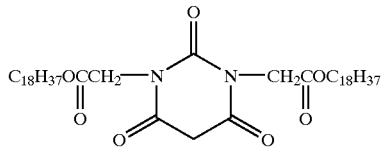

Preparation of Coating Solution

A 10% water solution of the above-mentioned compound (1) of the invention was added to the capsule solution containing the diazo compound prepared as described above such that the ratio of capsule solid components to compound (1) was 1:0.1. Then, the aforementioned coupler emulsified dispersion solution was mixed in the capsule solution containing the diazo compound such that the weight ratio of the coupler emulsified dispersion solution to the capsule solution was 3:2. Thus, coating solution 201(M) of example 6 was obtained.

For comparison, coating solution 202(M) of Comparative Example 3 was prepared in the same manner as the coating solution 201(M) except that the above-mentioned compound (1) was not added.

(3) Preparation of Yellow Heat-sensitive Recording Layer Solution

Preparation of Capsule Solution Containing Diazo Compound 3.0 parts of 2,5-dibutoxy-4-tolylthiobenzenediazonium hexafluorophosphate (diazo compound: decomposed by light having a wavelength of 420 nm) was dissolved in 20 parts of ethylacetate, and to this was further added 20 parts of alkylnaphthalene as a high boiling point solvent, and the resultant mixture was heated and mixed uniformly.

To the resulting solution 15 parts of adduct of xylylenediisocyanate/trimethylol propane (ratio thereof is 1:3) was added as a capsule wall agent, and stirred uniformly to prepare a solution of a diazo compound.

The resulting solution of a diazo compound was added to a solution formed by mixing 54 parts of aqueous solution comprising 6% by weight of phthalated gelatin and 2 parts of aqueous solution comprising 2% by weight of dodecyl sodium sulfonate, and emulsified and dispersed using a homogenizer.

To the resulting emulsified dispersion solution was added 68 parts of water, and the resultant solution was mixed uniformly and heated to 40° C. while being stirred, and a capsule-forming reaction was carried out for 3 hours so that the capsules having the average particle diameter of to 1.3 μm were formed. Thus, a capsule solution was obtained.

Preparation of Coupler Emulsified Dispersion Solution

The following components were dissolved in 10 parts of ethylacetate: 2 parts of 2-chloro-5-(3-(2,4-di-tert-pentyl) phenoxypropylamino)acetoanilide, 1 part of 1,2,3-triphenylguanidine, 0.3 parts of tricresyl phosphate and 0.1 parts of diethyl maleate. The resulting solution was poured into a mixed solution formed by mixing 20 parts of an aqueous solution containing 6% by weight of gelatin and 2 parts of aqueous solution containing 2% by weight of dodecyl sodium sulfonate, and emulsified for 10 minutes using a homogenizer to prepare an emulsified dispersion solution.

Preparation of Coating Solution

A 10% aqueous solution of the above-mentioned compound (1) of the invention was added to the capsule solution containing the diazo compound prepared as described above such that the ratio of capsule solid components to compound (1) was 1:0.1. Then the coupler emulsified dispersion solution was mixed in the capsule solution containing the diazo compound such that the weight ratio of the coupler emulsified dispersion solution to the capsule solution was 3:2. Thus, coating solution 201(Y) of Example 6 was obtained.

For comparison, coating solution 202(Y) of Comparative Example 3 was prepared in the same manner as the coating solution 201(Y) except that the above-mentioned compound (1) was not added to prepare.

(4) Preparation of Intermediate Layer Solution 3 parts of aqueous solution containing 15% by weight of polyacrylic acid (trade name: "Julimer AC-10L", manufactured by Nippon Jyunyaku Corporation), was added to 10 parts of aqueous solution containing 15% by weight of gelatin (trade name: "#750", manufactured by Nitta Gelatin Inc.) and mixed uniformly to prepare an intermediate layer solution.

(5) Preparation of Coating Solution of Light-transmittance Adjusting Layer 1.5 parts of the above-mentioned compound ("UVC-1"), 0.5 parts of the above-mentioned R-6 as a reducing agent, 6.0 parts of ethylacetate and 0.8 parts of tricresyl phosphate were mixed, and sufficiently dissolved. To this solution was added 3.0 parts of xylylenediisocyanate/trimethylol propane (75% ethylacetate solution, trade name: "Takenate D110N" manufactured by Takeda Chemical Industries, Ltd.) serving as a capsule wall forming agent, and stirred uniformly. 29.7 parts of an aqueous solution of 8% by weight of carboxy-denatured polyvinyl alcohol (trade name: "KL-318", manufactured by Kuraray Co., Ltd.) was prepared, and this was added to the above-mentioned mixed solution, and emulsified using a homogenizer. The resulting emulsion solution was added to 40 parts of ion exchanged water, and stirred for 3 hours at 40° C. so that a capsule-forming reaction was carried out. Thereafter, 7.0 parts of ion exchanged resin "Amberlite MB-03" (manufactured by Organo Corporation)

was added thereto, and further stirred for one hour. Thus, a target coating solution was prepared. The average particle size of the capsules was 0.35 μm.

| | |
|---|---|
| "EP130" (7% by weight) | 100 g |
| Water | 52 g |
| "Balifine BF21" dispersion solution (20% by weight) | 5 g |
| "Snowtex" (20% by weight) Colloidal silica dispersion: manufactured by Nissan Chemical Industries Ltd. | 5 g |
| Surfactant-1 (2% by weight) | 10 ml |
| Surfactant-2 (5% by weight) | 10 ml |
| "Surfron S131" (30% by weight) (fluorine containing surfactant; manufactured by Asahi Chemical Industry Co., Ltd.) | 1.5 g |
| Zinc stearate dispersing matter (20% by weight) | 3 g |

The above-mentioned materials were stirred uniformly to prepare a target coating solution.

(7) Preparation of Undercoat Layer Solution

To 2.5 parts by weight of oil-swelling synthetic mica "ME100" (manufactured by Co-op Chemical Co., Ltd.) was added 97.5 parts by weight of water, and dispersed by a dynamill. This was added to 200 g of aqueous solution containing 5% by weight of gelatin at 40° C., and stirred for 30 minutes, and 20 cc of the above-mentioned surfactant-1 (5% by weight) was added to this to prepare an undercoat layer solution.

(8) Formation of Heat-Sensitive Recording Material

Multiple coating solutions were applied onto the surface laminated with polyethylene of the paper support manufactured in Example 5 to form a multilayer structure such that the under coat layer solution, the cyan heat-sensitive recording layer solution, the intermediate layer solution, the magenta heat-sensitive recording layer, the intermediate layer solution, the yellow heat-sensitive recording layer, the light-transmittance adjusting layer solution and the protective layer solution were provided in that order from the support, and these layer were dried. In this way, multi-color heat-sensitive recording materials 201 and 202 of Example 6 and Comparative Example 3 were prepared.

Each of the above layers was coated respectively to have following coating amount. From the support side, the coating amount of the undercoat layer was 1 g/m$^2$, the coating amount of the cyan heat-sensitive recording layer was 6.1 g/m$^2$, the coating amount of the intermediate layer was 1.0 g/m$^2$, the coating amount of the magenta heat-sensitive recording layer was 7.8 g/m$^2$, the coating amount of the intermediate layer was 1.0 g/m$^2$, the coating amount of the yellow heat-sensitive recording layer was 7.2 g/m$^2$, the coating amount of the light-transmittance adjusting layer was 1.5 g/m$^2$ and the coating amount of the protective layer was 1.2 g/m$^2$. Here, the aforementioned coating amounts are those converted into amounts as solid components after drying. Thus, samples described in Table 3 (full-color heat-sensitive recording materials) were formed.

Thermal recording was carried out on the full color heat sensitive recording materials 201 and 202 thus formed, and evaluations were carried out on the gloss at gray image portions wherein B/W density thereof is about 0.7. Table 3 shows the results.

TABLE 3

| Heat-Sensitive Recording Material | Glossiness (20° Incidence) |
|---|---|
| 201 (Example) | 50.8 |
| 202 (Comparative Example) | 22.9 |

As clearly shown by Table 3, the full-color heat-sensitive recording materials of the invention have superior glossiness.

Example 7

A heat-sensitive recording material 301 was prepared in the same manner as in the preparation of the heat-sensitive recording material 201 of the Example 6, except that compound (2) having R=(S-1) and n=6, which the compound is represented by the general formula (I), was used in place of compound (1). Further, the same evaluations as Example 6 were carried out thereon, and the results are shown in Table 4.

Example 8

A heat-sensitive recording material 301 was prepared in the same manner as in the preparation of the heat-sensitive recording material 201 of the Example 6, except that compound (3) having R=(S-7) and n=10, which compound is represented by the general formula (I), was used in place of compound (1). Further, the same evaluations as example 6 were carried out thereon, and the results are shown in Table 4.

Example 9

A heat-sensitive recording material 303 was prepared in the same manner as in the preparation of the heat-sensitive recording material 201 of the Example 6, except that compound (4) having R=(S-8) and n=10, which the compound is represented by the general formula (I), was used in place of compound (1) Further, the same evaluations as Example 6 were carried out thereon, and the results are shown in Table 4.

TABLE 4

| Heat-Sensitive Recording Material | Compound | Glossiness (20° Incidence) |
|---|---|---|
| 301 | R = S − 1, n = 6 | 48.2 |
| 302 | R = S − 7, n = 10 | 49.5 |
| 303 | R = S − 8, n = 10 | 42.8 |

As clearly shown by Table 4, the heat-sensitive recording materials of the invention make it possible to prevent aggregation of capsules and latex in the heat-sensitive layers, and consequently to provide superior glossiness.

The heat-sensitive recording material of the invention makes it possible to improve the dispersing stability of coloring components and film-quality improving components contained in the heat-sensitive recording material, to provide uniform image quality in the resulting images, and also to form images with high sensitivity through imagewise heating by using a thermal head and an infrared laser, and to provide the resulting images having superior transparency and glossiness.

What is claimed is:

1. A heat-sensitive recording material comprising a support having disposed thereon plural layers including at least one heat-sensitive recording layer and a protective layer, the heat-sensitive recording layer containing at least two components that react with each other to form color by imagewise heating, wherein at least one of the plural layers contains a compound represented by the following general formula (I):

General formula (I)

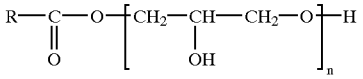

wherein R represents one of a hydrophobic group and a hydrophobic polymer, and n represents an integer.

2. The heat-sensitive recording material according to claim 1, wherein n is an integer of 2 to 30.

3. The heat-sensitive recording material according to claim 1, wherein n is an integer of 4 to 20.

4. The heat-sensitive recording material according to claim 1, wherein the heat-sensitive recording layer includes microcapsules in which at least one of the two components is encapsulated and the compound represented by the general formula (I).

5. The heat-sensitive recording material according to claim 1, wherein at least one of the at least one heat-sensitive recording layer and a layer adjacent thereto contains the compound represented by the general formula (I) and a latex dispersion solution.

6. The heat-sensitive recording material according to claim 1, wherein the at least one heat-sensitive recording layer includes a heat-sensitive coloring layer that contains as main components a diazo compound, a coupler that coupling-reacts with the diazo compound to form a color, and a binder, with the diazo compound being encapsulated in microcapsules.

7. The heat-sensitive recording material according to claim 1, wherein the at least one heat-sensitive recording layer includes a heat-sensitive coloring layer that contains as main components an electron-donating dye precursor and an electron-accepting compound, with at least one of the electron-donating dye precursor and the electron-accepting compound being encapsulated in microcapsules.

8. The heat-sensitive recording material according to claim 1, wherein the at least one heat-sensitive recording layer includes at least one of a heat-sensitive recording layer containing an electron-donating dye precursor and an electron-accepting compound, and a heat-sensitive recording layer containing a diazonium salt compound and a coupler that reacts with the diazonium salt compound to form a color.

9. The heat-sensitive recording material according to claim 1, wherein a light-transmittance adjusting layer, whose transmittance of light in a wavelength range required for light fixation is reduced after fixation, is formed on the at least one heat-sensitive recording layer.

10. The heat-sensitive recording material according to claim 1, further comprising at least one of an intermediate layer and an undercoat layer.

11. The heat-sensitive recording material according to claim 1, wherein the heat-sensitive recording material is a multicolor heat-sensitive recording material.

12. The heat-sensitive recording material according to claim 1, wherein the heat-sensitive recording material is a monochrome heat-sensitive recording material.

13. A method of manufacturing a heat-sensitive recording material, which includes a support and plural layers including a protective layer and at least one heat-sensitive recording layer containing at least two components that react with each other to form color by imagewise heating, the method comprising the steps of:

preparing a coating solution containing the at least two components that react to form a color by imagewise heating and a compound represented by the following general formula (I);

General formula (I)

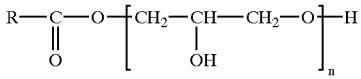

applying the solution onto a support and drying the solution to form the heat-sensitive recording layer; and forming the protective layer, wherein, in the general formula (I), R represents one of a hydrophobic group and a hydrophobic polymer, and n represents an integer.

14. The method according to claim 13, wherein n is an integer of 2 to 30.

15. The method according to claim 13, wherein n is an integer of 4 to 20.

16. The method according to claim 13, wherein one of said at least two components is encapsulated in microcapsules.

17. The method according to claim 13, wherein the step of preparing a coating solution further comprises the substep of preparing a dispersion containing microcapsules comprising one of the two components, an emulsion comprising the other component of the two components and a latex dispersion comprising the compound represented by the general formula (I), and mixing them.

18. The method according to claim 13, wherein the at least two components are a diazo compound and a coupler that reacts with the diazo compound to develop a color.

19. The method according to claim 13, wherein the at least two components are an electron-donating dye precursor and an electron-accepting compound.

* * * * *